US011459824B2

(12) United States Patent
Cohen

(10) Patent No.: US 11,459,824 B2
(45) Date of Patent: Oct. 4, 2022

(54) SAFETY ACCESSORY

(71) Applicant: Ladder Reach Safety System LLC, Fogelsville, PA (US)

(72) Inventor: Leon Cohen, Seaford, NY (US)

(73) Assignee: Ladder Reach Safety System LLC, Fogelsville, PA (US)

( * ) Notice: Subject to any disclaimer, the term of this patent is extended or adjusted under 35 U.S.C. 154(b) by 375 days.

(21) Appl. No.: 16/547,619

(22) Filed: Aug. 22, 2019

(65) Prior Publication Data

US 2020/0115959 A1 Apr. 16, 2020

Related U.S. Application Data

(60) Provisional application No. 62/744,149, filed on Oct. 11, 2018.

(51) Int. Cl.
*E06C 7/18* (2006.01)
*E06C 7/14* (2006.01)

(52) U.S. Cl.
CPC ..... *E06C 7/186* (2013.01); *E06C 7/14* (2013.01); *E06C 7/182* (2013.01)

(58) Field of Classification Search
CPC ..... E06C 7/14; E06C 7/182; E06C 7/186
See application file for complete search history.

(56) References Cited

U.S. PATENT DOCUMENTS 2,010,588 A * 8/1935 Gooden ..... E06C 7/182 182/106
2,656,088 A * 10/1953 White ..... E06C 7/182 182/106

(Continued)

FOREIGN PATENT DOCUMENTS

EP 1921249 B1 11/2006
EP 3015640 B1 9/2015

(Continued)

OTHER PUBLICATIONS https://www.discountramps.com/qrt-standard-retractor/p/Q8-6201-L/.
http://antennaproducts.com/product/ap-safety~harness/.
https://easi~dec.com/m/guides/hands-free-ladder.

*Primary Examiner* — Colleen M Chavchavadze
(74) *Attorney, Agent, or Firm* — Brad M. Behar & Associates, PLLC

(57) ABSTRACT

A safety accessory for stabilizing a user on a step ladder is provided. The safety accessory includes an elongate member having a shaft and at least one handle portion extending perpendicularly to the shaft and structured to be gripped by the user, the handle portion having a strap ring; a harness configured to removeably couple to the strap ring of the handle portion, the harness being structured to cradle and urge the user toward the center of gravity of the step ladder when the user stands on at least one of the plurality of steps of the step ladder; and a clamp configured to removeably attach to a selected location on the side rail of the step ladder, the clamp having a receptacle structured to slideably receive the shaft of the elongate member and a positioning structure configured to maintain the shaft of the elongate member into a selected one of a plurality of longitudinal positions with respect to the clamp. The safety accessory acts to stabilize the user when he/she grips the handle portion of the elongate member.

12 Claims, 21 Drawing Sheets

(56) References Cited

U.S. PATENT DOCUMENTS

| | | | | | |
|---|---|---|---|---|---|
| 2,883,134 | A * | 4/1959 | O'Halloran | E06C 7/14 | 248/210 |
| 2,886,227 | A | 5/1959 | Rose | | |
| 2,942,830 | A * | 6/1960 | Senay | E06C 7/14 | 248/316.4 |
| 2,954,093 | A * | 9/1960 | Fitzgerald | E06C 7/14 | 182/129 |
| 3,598,200 | A | 8/1971 | Thompson | | |
| 3,908,791 | A | 9/1975 | Kleine et al. | | |
| 4,709,783 | A * | 12/1987 | Tomioka | E06C 7/186 | 182/198 |
| 4,798,262 | A * | 1/1989 | Margolies | E06C 1/20 | 182/172 |
| 5,065,838 | A | 11/1991 | Finley | | |
| 5,788,198 | A * | 8/1998 | Sharpe | E06C 7/16 | 248/210 |
| 5,791,436 | A | 8/1998 | Talley, Sr. | | |
| 5,924,523 | A | 7/1999 | Krause | | |
| 6,145,620 | A * | 11/2000 | Strunk | E06C 7/14 | 182/129 |
| 6,161,647 | A | 12/2000 | Braden et al. | | |
| 6,607,053 | B1 | 8/2003 | Warren | | |
| 7,219,766 | B2 | 5/2007 | Deuer | | |
| 8,413,764 | B1 | 4/2013 | Cohen et al. | | |
| 8,602,162 | B2 | 12/2013 | Dondurur et al. | | |
| 8,839,908 | B2 | 9/2014 | Davis, Jr. | | |
| 9,016,434 | B2 | 4/2015 | Moss et al. | | |
| 9,540,875 | B2 | 1/2017 | Ellis | | |
| 9,663,990 | B2 * | 5/2017 | Kramer | E06C 5/02 | |
| D797,955 | S | 9/2017 | Wilbur | | |
| 9,810,022 | B1 * | 11/2017 | Ayala | E06C 7/14 | |
| 2005/0161284 | A1 | 7/2005 | Casebolt et al. | | |
| 2011/0011674 | A1 | 1/2011 | Kim | | |
| 2020/0248507 | A1 * | 8/2020 | Moss | E06C 7/182 | |

FOREIGN PATENT DOCUMENTS

| | | | | |
|---|---|---|---|---|
| GB | 2345720 | A * | 7/2000 | E06C 1/22 |
| JP | 2015031103 | A | 2/2015 | |
| WO | WO-2021202705 | A1 * | 10/2021 | |

* cited by examiner

SAFETY ACCESSORY

CROSS REFERENCE

This application claims the benefit of U.S. Provisional Application Ser. No. 62/744,149 filed on Oct. 11, 2018 which is expressly incorporated herein in its entirety by reference thereto.

FIELD OF INVENTION

The present invention relates to safety accessories for use with ladders and, in particular, to a safety accessory for stabilizing a user on a step ladder.

BACKGROUND OF THE INVENTION

Step ladders are commonly used around the house, the office, as well as during construction. A short step ladder comprising three or four steps, for example, is often used to reach items stored on shelves, to replace light bulbs, to hang items on walls or from a ceiling, or to paint. Users of step ladders sometimes accidentally fall off step ladders causing injury. Falls may also occur when a step ladder is used incorrectly, such as when a user stands on the uppermost platform of the step ladder (which is typically not designed to be stood upon) or when the user leans excessively or reaches too far from the ladder, which may cause user to fall off and/or cause the step ladder to tip. There is a need for a way to give users more stability, as well as the feeling of stability, when on the step ladder. There is a need for a harness connected to the step ladder that provides a sense of stability as well as an ability to use one or both hands while on the step ladder, without holding onto anything, and without fear of falling. There is a need for a device to address these disadvantages and reduce falls and unsteadiness.

SUMMARY OF THE INVENTION

Applicant has invented a new safety accessory that overcomes these and other shortcomings. The safety accessory includes a handle that extends at an angle upwards and over the uppermost platform of a step ladder. The handle is structured to be grasped with one or both hands to help stabilize a user on the step ladder. A harness is also provided for cradling and urging the user toward the center of gravity of the ladder, thereby providing additional stability by preventing excessive leaning which would otherwise cause the user to fall and/or cause the step ladder to tip over. The safety accessory also permits the handle to be adjusted into multiple positions to accommodate different sized users or the requirements of a particular task to be performed using the step ladder. The handle may also be adjusted to a storage position to reduce the profile of the accessory when storing the step ladder. The safety accessory also includes an adjustable clamp that permits attachment of the safety accessory to different types and brands of step ladders. The safety accessory may be manufactured and sold integrally with a step ladder or, alternatively, be sold as an accessory to attach to standard step ladders.

In accordance with one embodiment of the present invention, a safety accessory is provided for stabilizing a user on a step ladder having an uppermost platform, a plurality of steps, at least one side rail, and a center of gravity, the safety accessory comprising: an elongate member having a shaft and at least one handle portion extending perpendicularly to the shaft and structured to be gripped by the user, the handle portion having a strap ring; a harness configured to removeably couple to the strap ring of the handle portion, the harness being structured to cradle and urge the user toward the center of gravity of the step ladder (or prevent the user from being too far from the center of gravity of the step ladder) when the user stands on at least one of the plurality of steps of the step ladder; and a clamp configured to removeably attach to a selected location on the side rail of the step ladder, the clamp having a receptacle structured to slideably receive the shaft of the elongate member and a positioning structure configured to maintain the shaft of the elongate member into a selected one of a plurality of longitudinal positions with respect to the clamp; in which the handle portion of the elongate member is positioned above the uppermost platform of the step ladder when the shaft of the elongate member is extended into the selected longitudinal position with respect to the clamp, in which the user is stabilized on the step ladder when the user grips the handle portion of the elongate member.

In accordance with another embodiment of the present invention, the clamp includes a receiving plate having a plate flange and at least one guide notch, an L-bracket having a bracket flange and at least one guide rail, the guide notch of the receiving plate being configured to slideably receive the guide rail of the L-bracket for adjusting a clamping distance between the plate flange and the bracket flange, the clamping distance being adjustable to a width of the side rail for gripping the side rail between the plate flange and the bracket flange; and at least one positioning screw configured to lock the L-bracket to the receiving plate after the clamping distance is adjusted to the width of the side rail.

In accordance with still another embodiment of the present invention, the at least one guide rail includes a threaded rail bore, the clamp further including at least one tightening screw, the tightening screw having a threaded bolt with first and second ends, the threaded bolt being screwably disposed through the threaded rail bore; a pusher plate coupled to the first end of the threaded bolt; a wingnut screwably engaged with the threaded bolt adjacent to the second end of the threaded bolt; a locking nut screwably engaged with the threaded bolt adjacent to the wingnut, the locking nut and the wingnut being arranged in a double-nut configuration; and a hexagonal nut screwably engaged with the threaded bolt adjacent to the locking nut; in which rotation of the threaded bolt along a tightening direction causes the pusher plate to advance toward and frictionally engage an inside surface of the side rail of the step ladder to sandwich the side rail between the receiving plate and the pusher plate, in which rotation of the hexagonal nut along a tightening direction causes the hexagonal nut to advance toward the guide rail.

In accordance with yet another embodiment of the present invention, the clamp includes at least one placement protrusion structured to rest on one of the plurality of steps of the step ladder to assist with positioning of the clamp when the clamp is removeably attached to the selected location on the side rail of the ladder.

In accordance with still another embodiment of the present invention, the shaft of the elongate member includes a plurality of length adjustment holes, the receptacle of the clamp includes at least one locking hole, and the positioning structure of the clamp includes a locking pin having a transverse bore, the locking pin structured to be removeably inserted through the locking hole and a selected set of the length adjustment holes to position the shaft into the selected longitudinal position with respect to the clamp; a cotter pin structured to be inserted into the transverse bore of the locking pin for preventing removal of the locking pin from the locking hole and the selected set of length adjustment holes; and a chain having first and second ends, the first end of the chain being coupled to the locking pin, the second end of the chain being coupled to the receptacle, the chain structured to maintain the locking pin with the receptacle when the locking pin is not inserted through the locking hole and the selected set of length adjustment holes.

In accordance with yet another embodiment of the present invention, the positioning structure of the clamp further includes a tightening ring configured to be tightened around the shaft of the elongate member for rigidly maintaining the shaft of the elongate member within the receptacle of the clamp.

In accordance with still another embodiment of the present invention, the shaft of the elongate member includes a plurality of markings corresponding to the plurality of longitudinal positions.

In accordance with yet another embodiment of the present invention, the handle portion extends toward the uppermost platform of the step ladder.

In accordance with still another embodiment of the present invention, insertion of the locking pin through the locking hole and a selected set of the length adjustment holes positions the shaft into a selected one of a plurality of angular positions with respect to the clamp.

In accordance with yet another embodiment of the present invention, one of the plurality of angular positions includes an angular position at which the handle portion of the elongate member extends over a side of the step ladder.

In accordance with still another embodiment of the present invention, the strap ring of the handle portion is configured to hold at least one user accessory.

In accordance with yet another embodiment of the present invention, the at least one user accessory includes a paint can or a tool bucket or the like.

In accordance with still another embodiment of the present invention, an inside surface of the receptacle includes a guide protrusion and an outside surface of the shaft of the elongate member includes a travel groove extending longitudinally along the shaft and a plurality of circumferentially disposed placement grooves corresponding to the plurality of length adjustment holes, in which engagement of the guide protrusion with a selected one of the placement grooves prevents longitudinal displacement of the shaft with respect to the receptacle, and engagement of the guide protrusion with the travel groove permits longitudinal displacement of the shaft with respect to the receptacle.

In accordance with yet another embodiment of the present invention, the harness includes a strap having a first end, a second end and a length; a first strap clip coupled to the first end of the strap; a second strap clip coupled to the second end of the strap, the first and second strap clips being configured to be removeably coupled to the strap ring of the handle portion; and a length adjustment buckle structured to permit adjustment of the length of the strap.

In accordance with still another embodiment of the present invention, a safety accessory is provided for stabilizing a user on a step ladder having an uppermost platform, a plurality of steps, at least one side rail, and a center of gravity, the safety accessory comprising: an elongate member having a shaft and at least one handle portion extending perpendicularly to the shaft and structured to be gripped by the user, the handle portion having a strap ring; a strap extender including an extender body, an extender strap extending from the extender body, a first coupling clip attached to the extender strap, a second coupling clip attached to the extender body, the second coupling clip being configured to removeably attach to the strap ring of the handle portion, the strap extender being configured to permit adjustment of a length of the extender strap; a harness configured to removeably couple to the first coupling clip of the strap extender, the harness being structured to cradle and urge the user toward the center of gravity of the step ladder when the user stands on at least one of the plurality of steps of the step ladder; and a clamp configured to removeably attach to a selected location on the side rail of the step ladder, the clamp having a receptacle structured to slideably receive the shaft of the elongate member and a positioning structure configured to maintain the shaft of the elongate member into a selected one of a plurality of longitudinal positions with respect to the clamp; in which the handle portion of the elongate member is positioned above the uppermost platform of the step ladder when the shaft of the elongate member is extended into the selected longitudinal position with respect to the clamp, in which the user is stabilized on the step ladder when the user grips the handle portion of the elongate member.

In accordance with yet another embodiment of the present invention, a safety accessory is provided for stabilizing a user on a step ladder having an uppermost platform, a plurality of steps, at least one side rail, and a center of gravity, the safety accessory comprising: an elongate member having a shaft and at least one handle portion extending perpendicularly to the shaft and structured to be gripped by the user, the handle portion having a strap ring; a harness configured to removeably couple to the strap ring of the handle portion, the harness being structured to cradle and urge the user toward the center of gravity of the step ladder when the user stands on at least one of the plurality of steps of the step ladder; a clamp configured to removeably attach to a selected location on the side rail of the step ladder, the clamp having an extender bar and a receptacle coupled to the extender bar, the extender bar including a height adjustment groove, the receptacle being structured to slideably receive the shaft of the elongate member, the clamp further having a positioning structure configured to maintain the shaft of the elongate member into a selected one of a plurality of longitudinal positions with respect to the clamp; and a stabilization bracket having a bottom surface structured to rest on the uppermost platform of the step ladder, a height adjustment bolt structured to slideably engage with the height adjustment groove of the extender bar, a plurality of width adjustment blocks for straddling the uppermost platform; and a plurality of locking nuts for locking the stabilization bracket in place with respect to the clamp and the uppermost platform; in which the handle portion of the elongate member is positioned above the uppermost platform of the step ladder when the shaft of the elongate member is extended into the selected longitudinal position with respect to the clamp, in which the user is stabilized on the step ladder when the user grips the handle portion of the elongate member.

In accordance with still another embodiment of the present invention, a safety accessory is provided for stabilizing a user on a step ladder having an uppermost platform, a plurality of steps, a left side rail, a right side rail, and a center of gravity, the safety accessory comprising: a first clamp configured to removeably attach to the left side rail of the step ladder, the first clamp having a first receptacle and a first positioning structure; a second clamp configured to removeably attach to the right side rail of the step ladder, the second clamp having a second receptacle and a second positioning structure; a U-shaped elongate member having a left shaft, a right shaft, and a handle portion extending perpendicularly to the left and right shafts and having a strap ring, the handle portion structured to be gripped by the user, the first receptacle of the first clamp structured to slideably receive the left shaft of the elongate member; the second receptacle of the second clamp structured to slideably receive the right shaft of the elongate member; the first positioning structure being configured to maintain the left shaft of the elongate member into a selected one of a plurality of longitudinal positions; the second positioning structure being configured to maintain the right shaft of the elongate member into the selected one of the plurality of longitudinal positions; and a harness configured to removeably couple to the strap ring of the handle portion, the harness being structured to cradle and urge the user toward the center of gravity of the step ladder when the user stands on at least one of the plurality of steps of the step ladder; in which the handle portion of the elongate member is positioned above the uppermost platform of the step ladder when the left and right shafts of the elongate member are extended into the selected longitudinal position, in which the user is stabilized on the step ladder when the user grips the handle portion of the elongate member.

DETAILED DESCRIPTION

Figure 1:
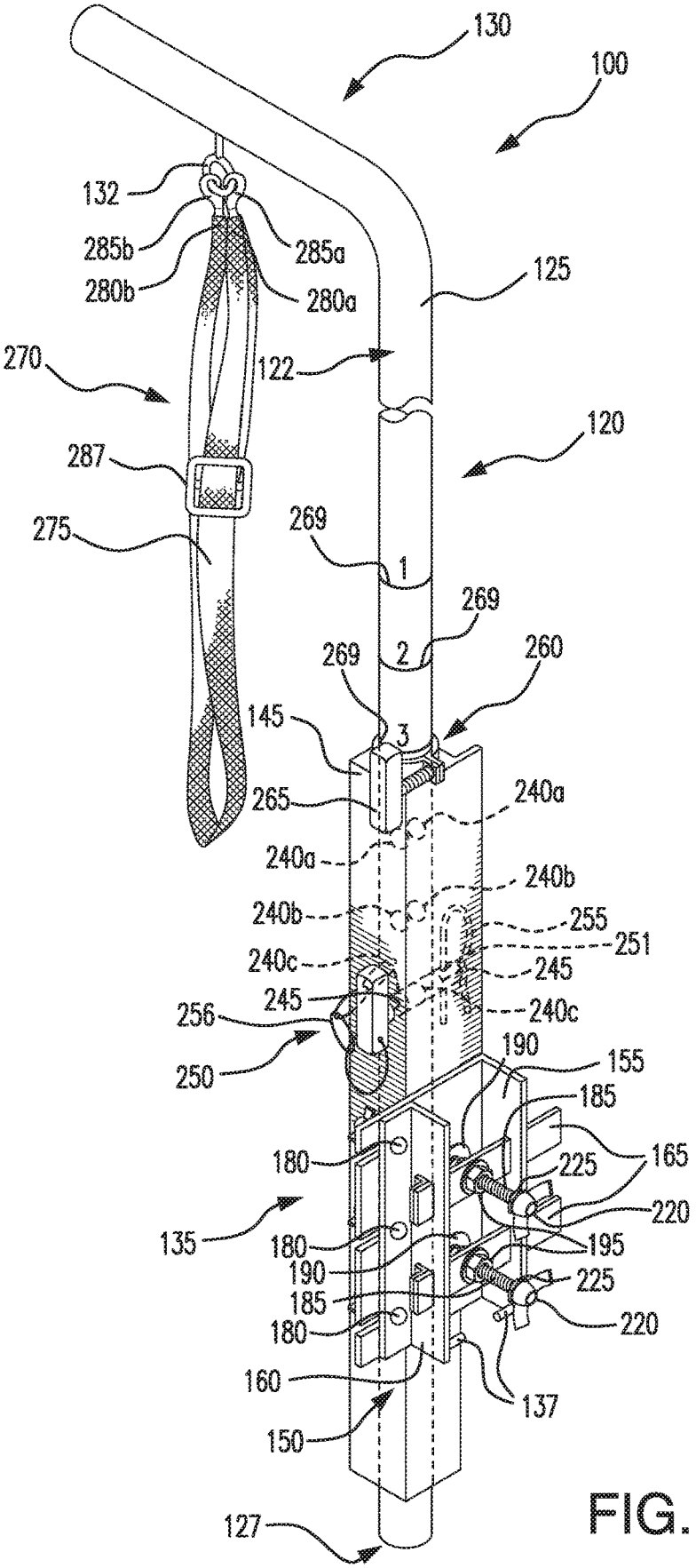
FIG. 1 is a perspective view of a safety accessory according to the present invention.
Figure 2:
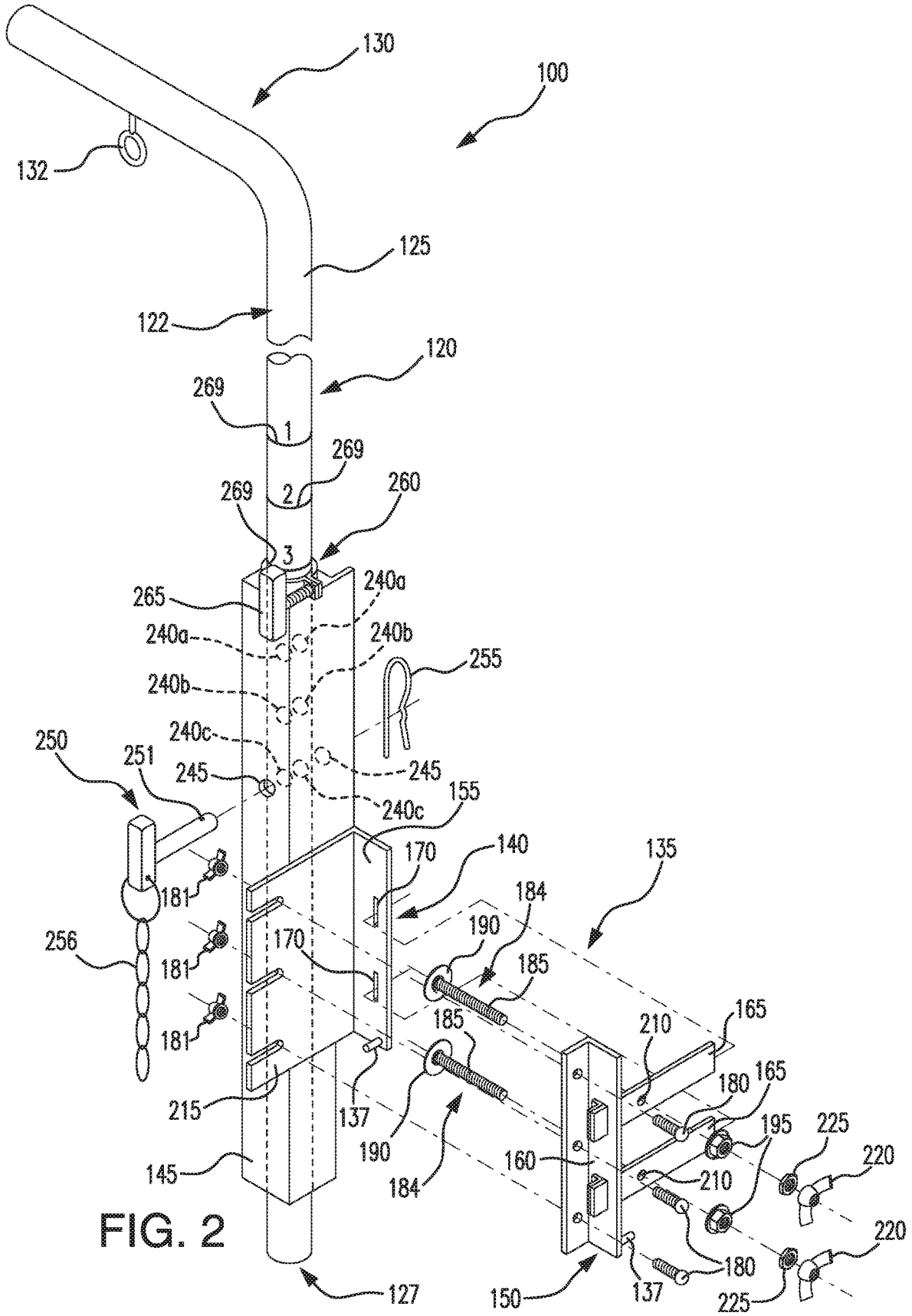
FIG. 2 is an exploded perspective view of the safety accessory depicted in FIG. 1, according to the present invention.
Figure 3:
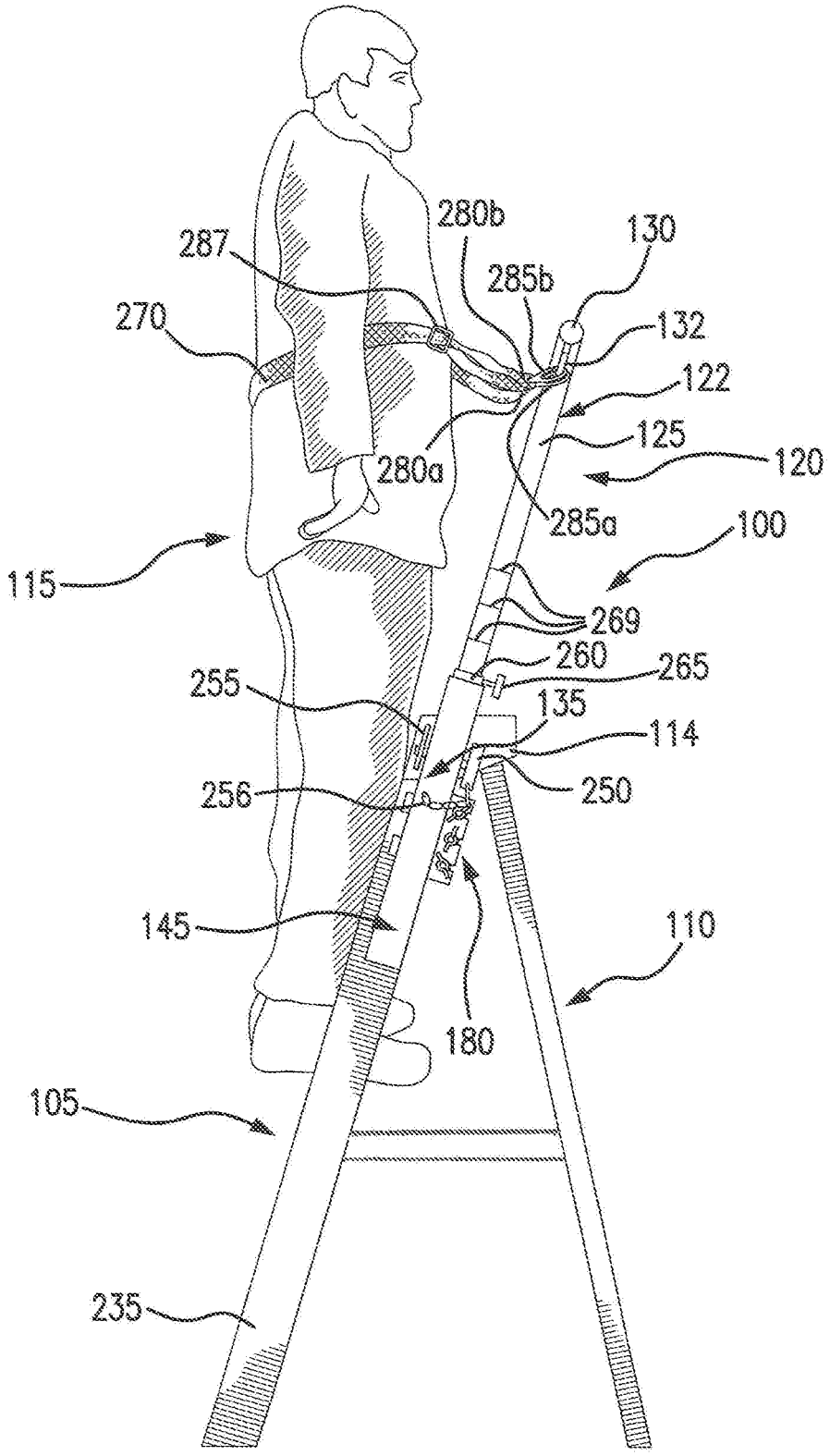
FIG. 3 is a side view of the safety accessory depicted in FIG. 1 attached to a step ladder, according to the present invention.
Figure 4:
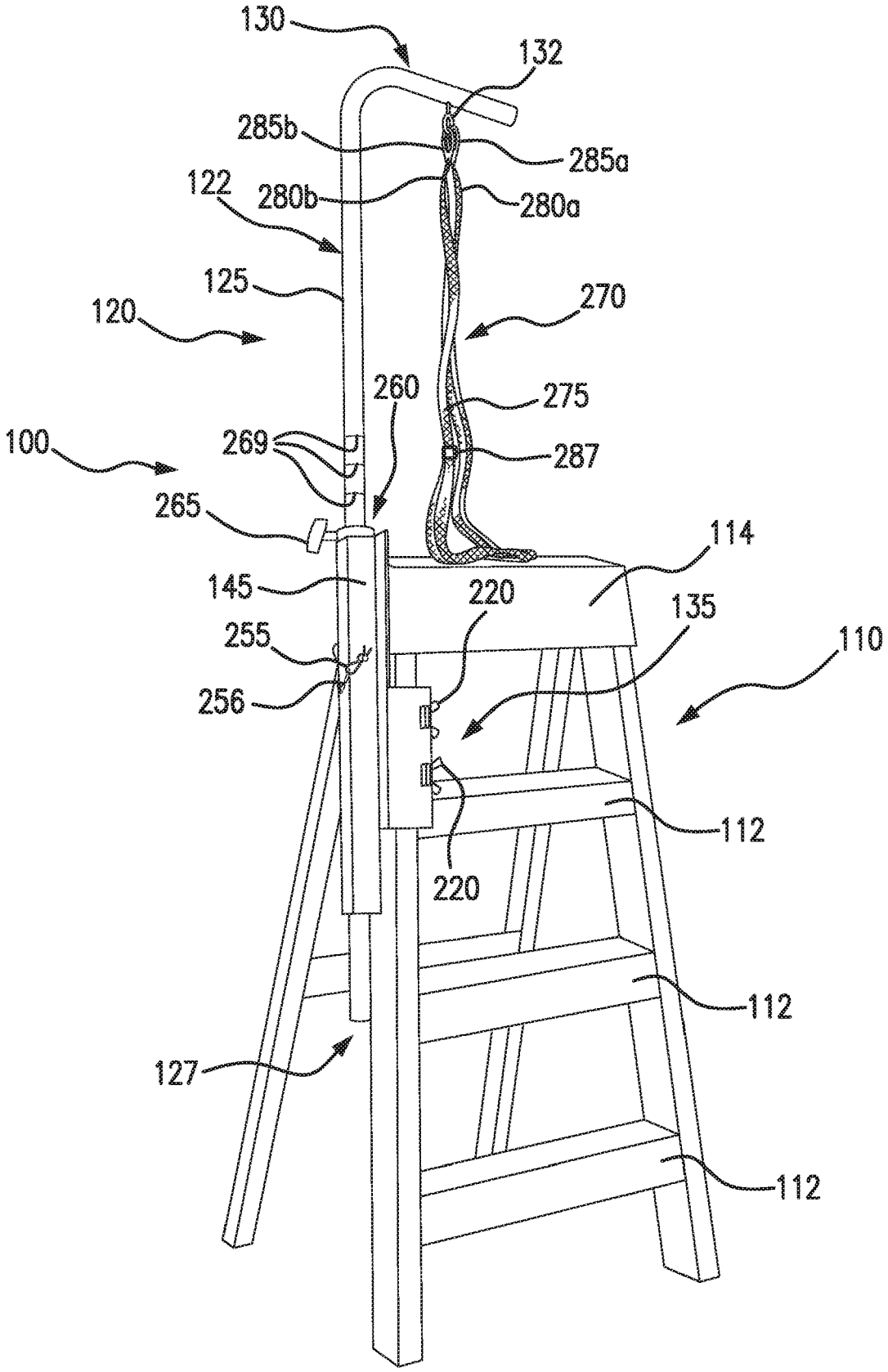
FIG. 4 is a perspective view of the safety accessory depicted in FIG. 1 attached to a step ladder, according to the present invention.

Reference will now be made in detail to the preferred embodiments of the invention illustrated in the accompanying drawings. Wherever possible, the same or like reference numbers will be used throughout the drawings to refer to the same or like features. It should be noted that the drawings are in simplified form and are not drawn to precise scale. In reference to the disclosure herein, for purposes of convenience and clarity only, directional terms such as top, bottom, above, below and diagonal, are used with respect to the accompanying drawings. Such directional terms used in conjunction with the following description of the drawings should not be construed to limit the scope of the invention in any manner not explicitly set forth. Additionally, the term "a," as used in the specification, means "at least one." The terminology includes the words above specifically mentioned, derivatives thereof, and words of similar import. "About" as used herein when referring to a measurable value such as an amount, a temporal duration, and the like, is meant to encompass variations from the specified value, as such variations are appropriate.

Referring now to FIGS. 1 through 4, there is seen a safety accessory 100 according to the present invention. Safety accessory 100 includes a clamp 135 configured to removeably attach to a selected location on a side rail 105 of step ladder 110 and an adjustable length elongate member 120 having a handle portion 130 structured to be gripped by a user 115 for enhancing his/her stability when standing on step ladder 110. A harness 270 (which may be made of fabric or other appropriate material) is also provided for cradling and urging user 115 toward the center of gravity of step ladder 110 and/or supporting the user 115, thereby further increasing stability and reducing, if not eliminating, the possibility that user 115 may inadvertently lean too far back, causing step ladder 110 to tip backwards or otherwise become unstable. It should be appreciated that, although safety accessory 100 is described herein with respect to use with step ladder 110, safety accessory 100, as well as other safety accessories contemplated by the present invention, may be used with other types of ladders, such as, for example, extension ladders, platform ladders, step stools, telescoping ladders, folding ladders, etc.

Figure 5:
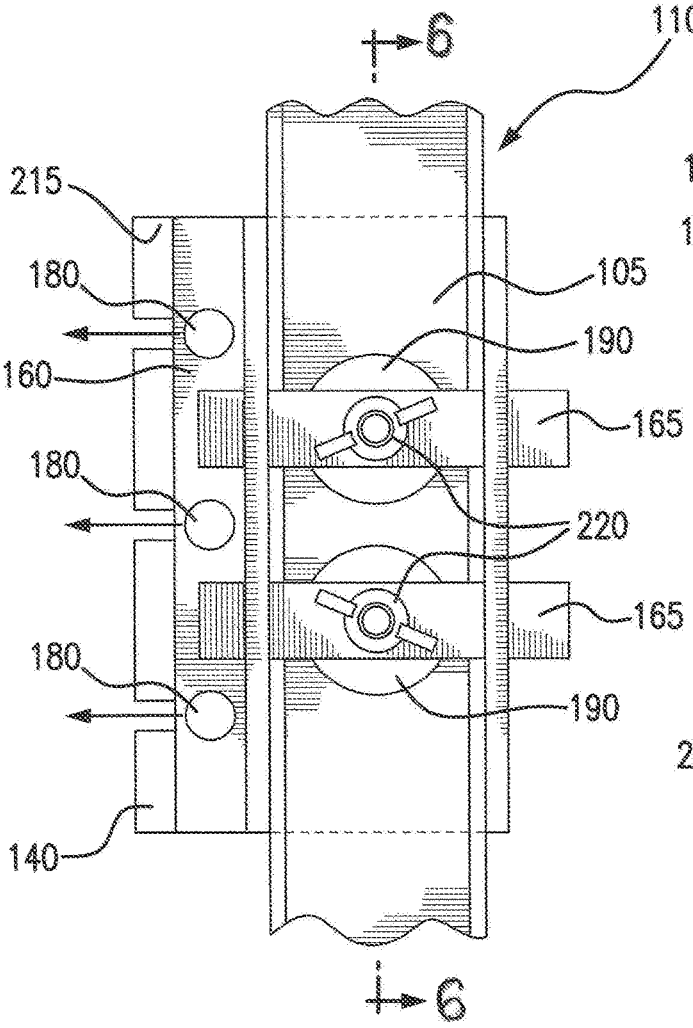
FIG. 5 is a front view of a clamp of the safety accessory depicted in FIG. 1, according to the present invention.
Figure 6:
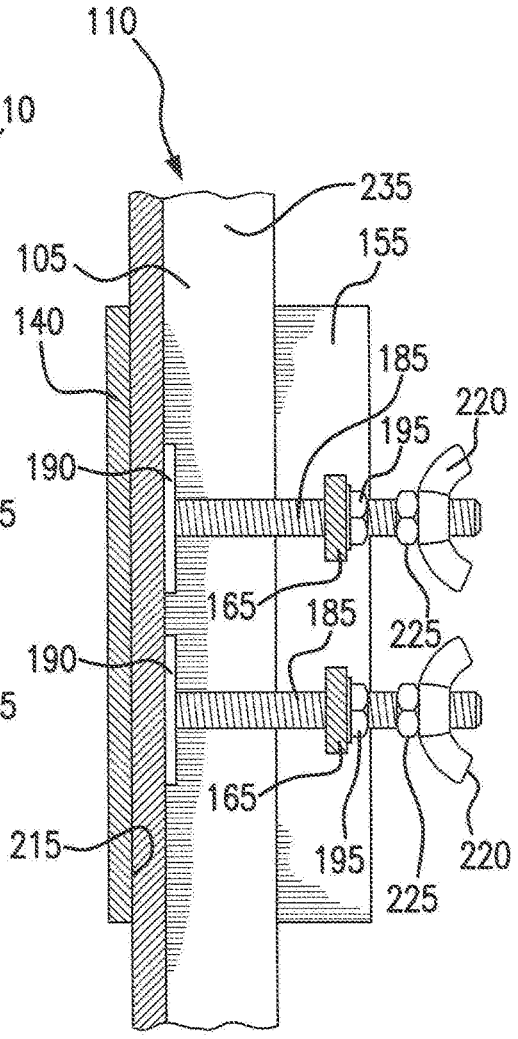
FIG. 6 is a section view of a clamp of the safety accessory depicted in FIG. 5, according to the present invention.
Figure 7:
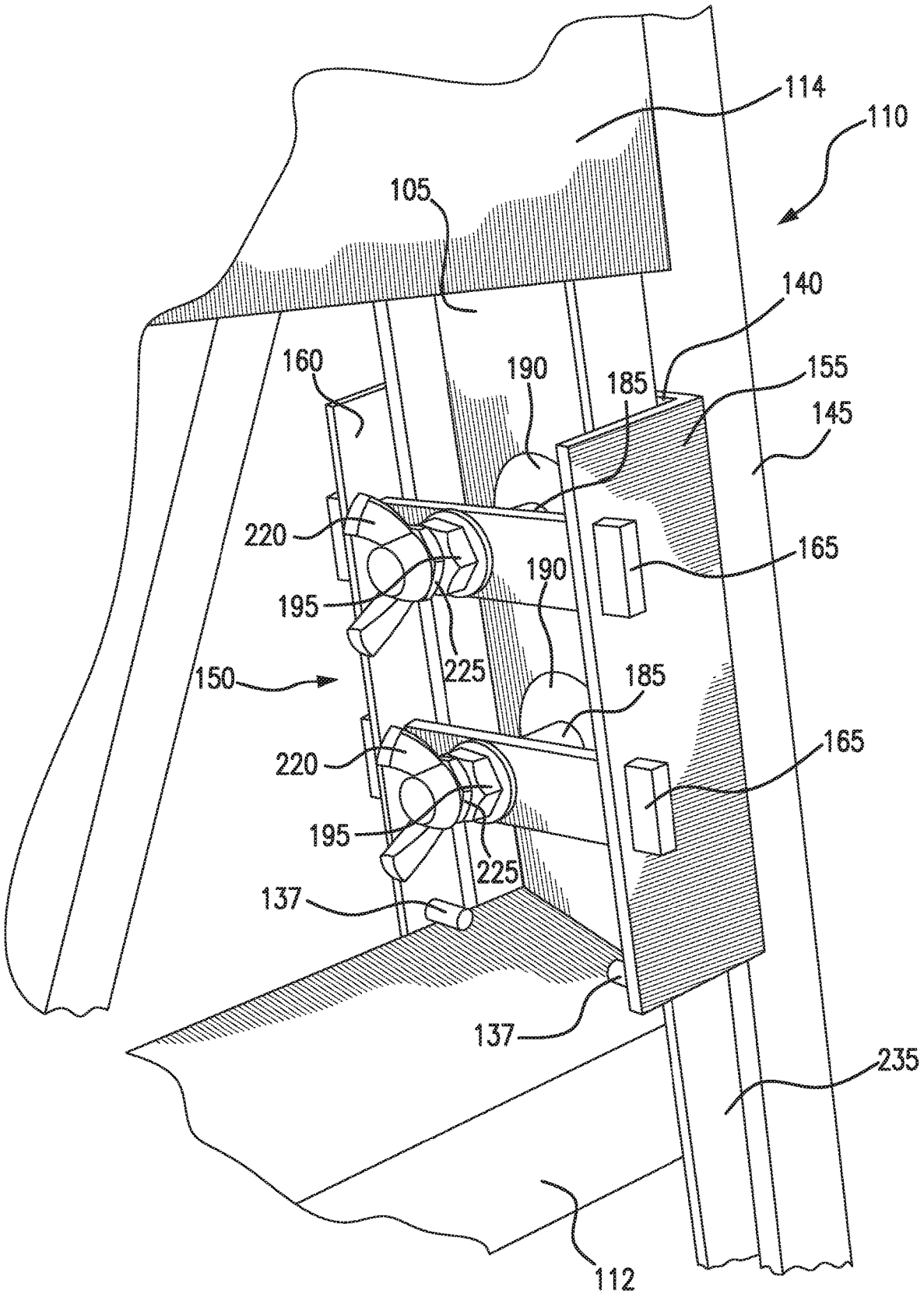
FIG. 7 is a perspective view of a clamp of the safety accessory depicted in FIG. 1 attached to a step ladder, according to the present invention.
Figure 8:
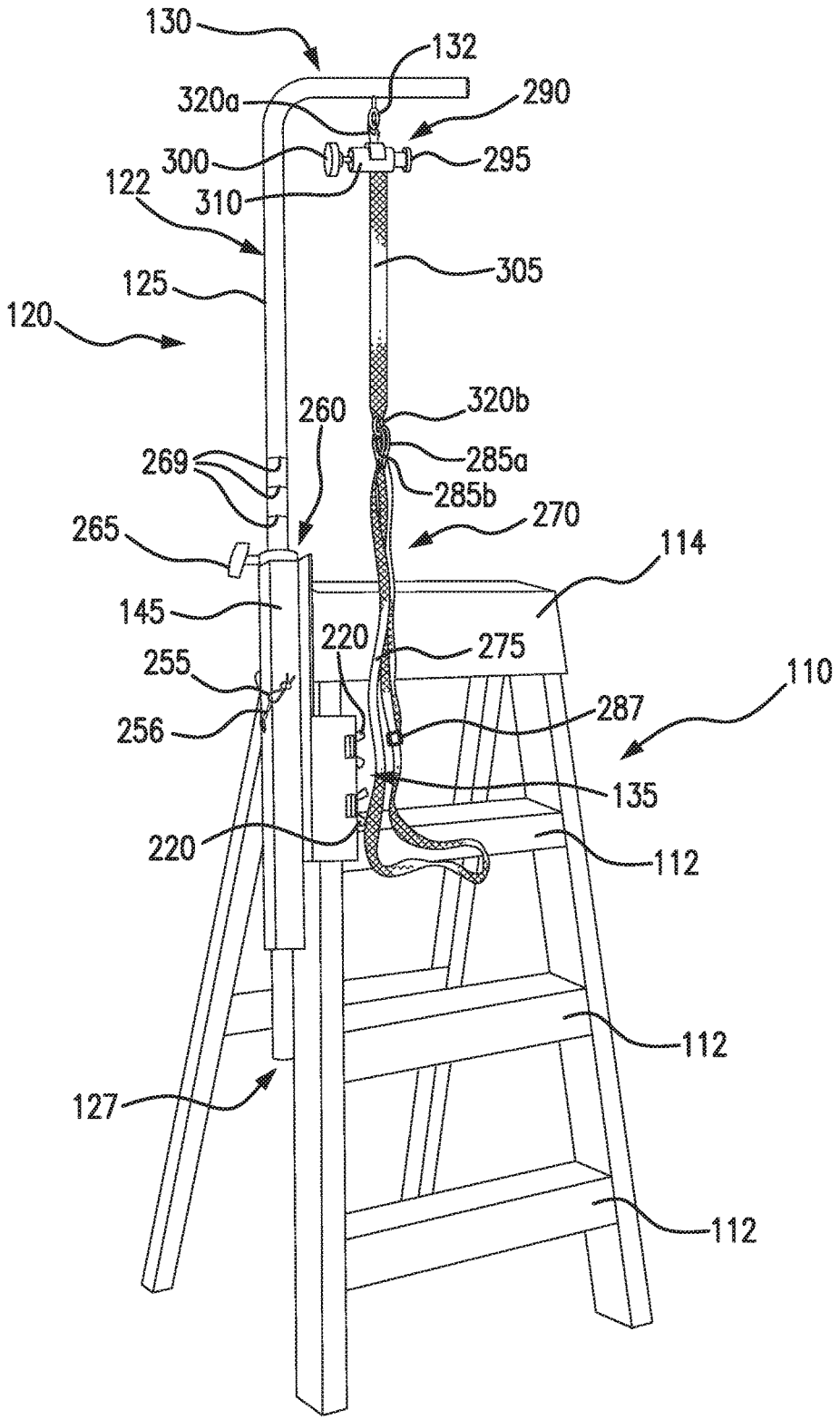
FIG. 8 is a perspective view of the safety accessory depicted in FIG. 1 with an exemplary strap extender, according to the present invention.
Figure 9:
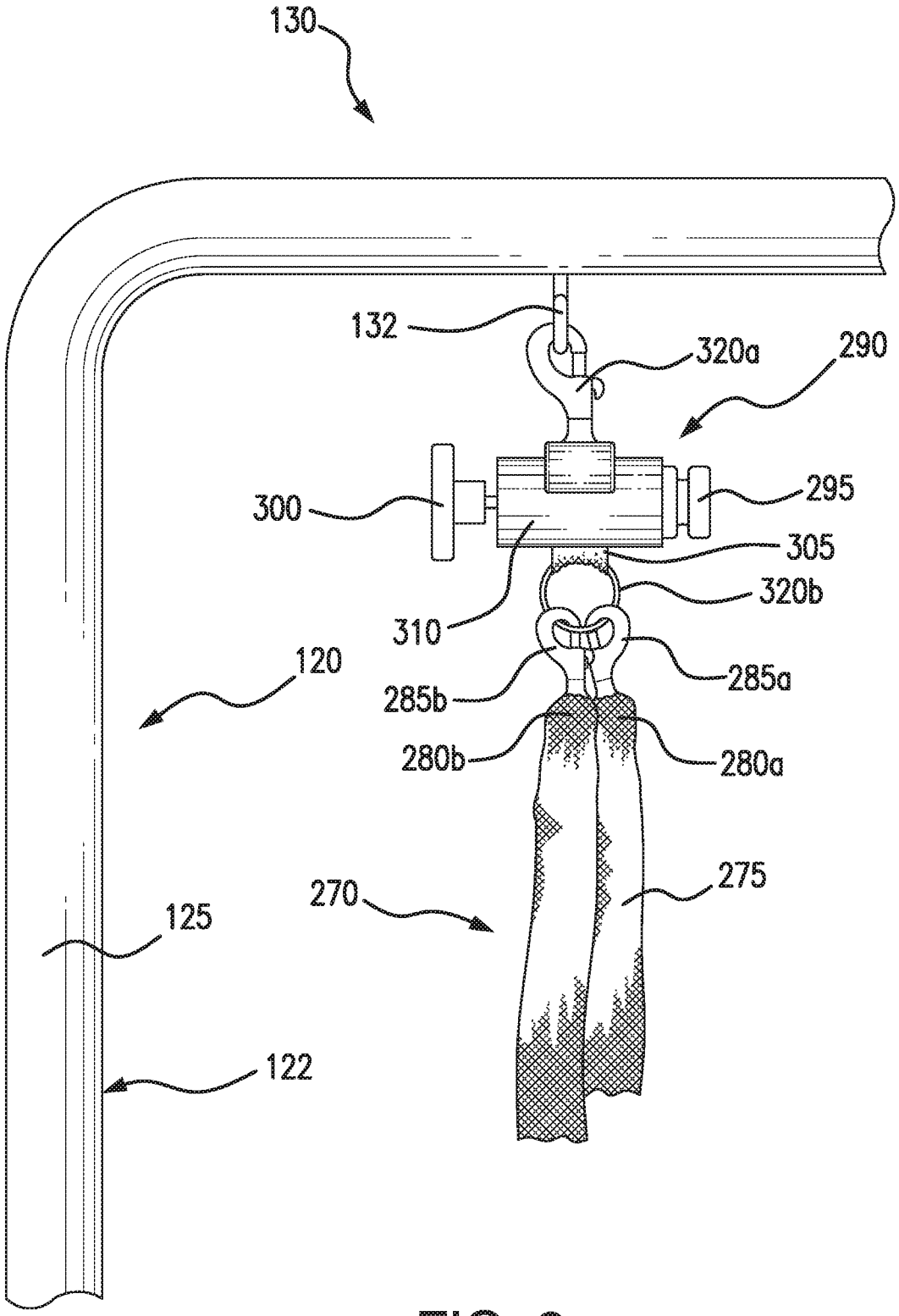
FIG. 9 is a front view of a strap extender attached to the safety accessory depicted in FIG. 1, according to the present invention.
Figure 10:
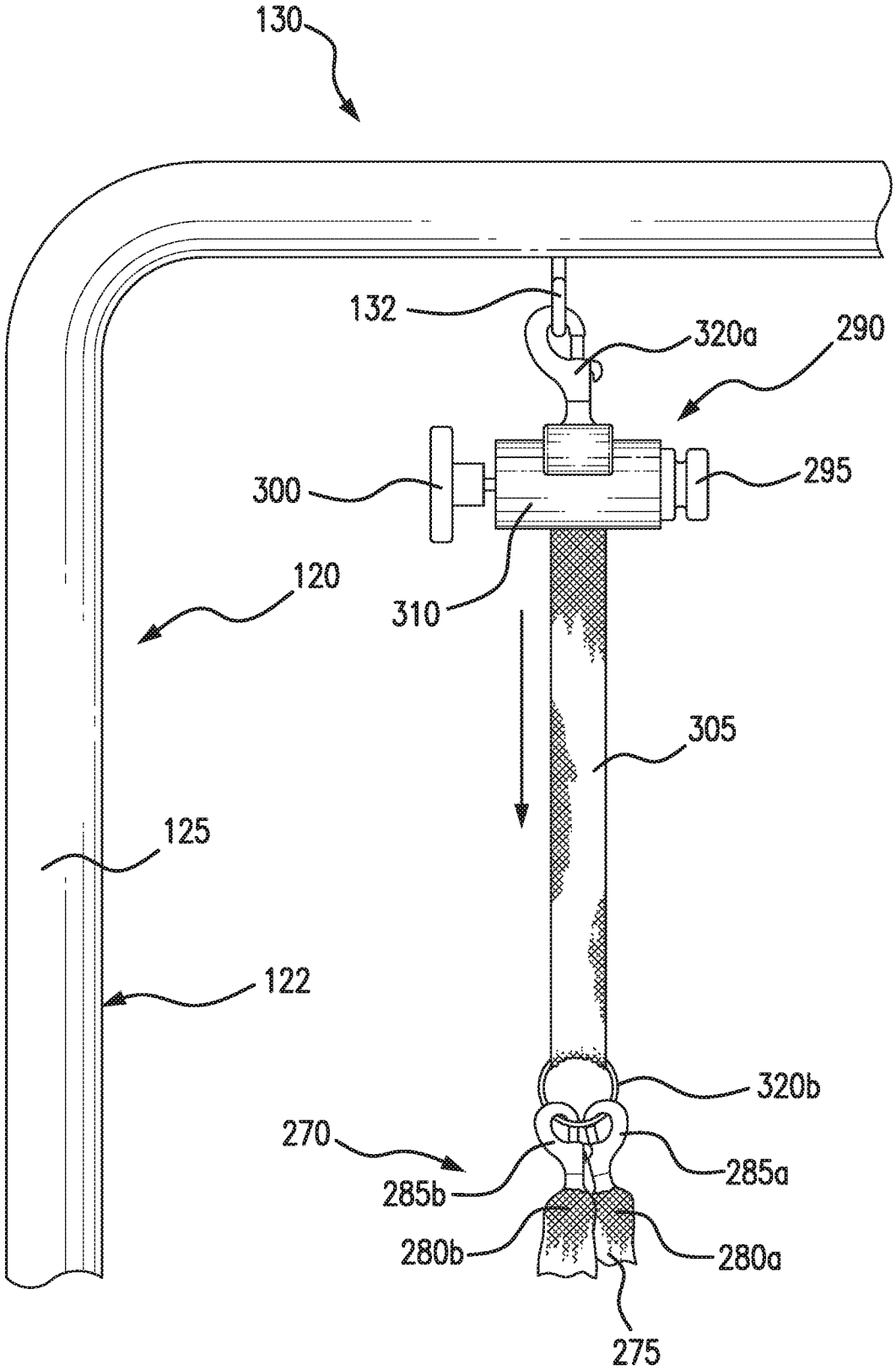
FIG. 10 is a front view of the strap extender depicted in FIG. 9 with an extender strap extended therefrom, according to the present invention.
Figure 11:
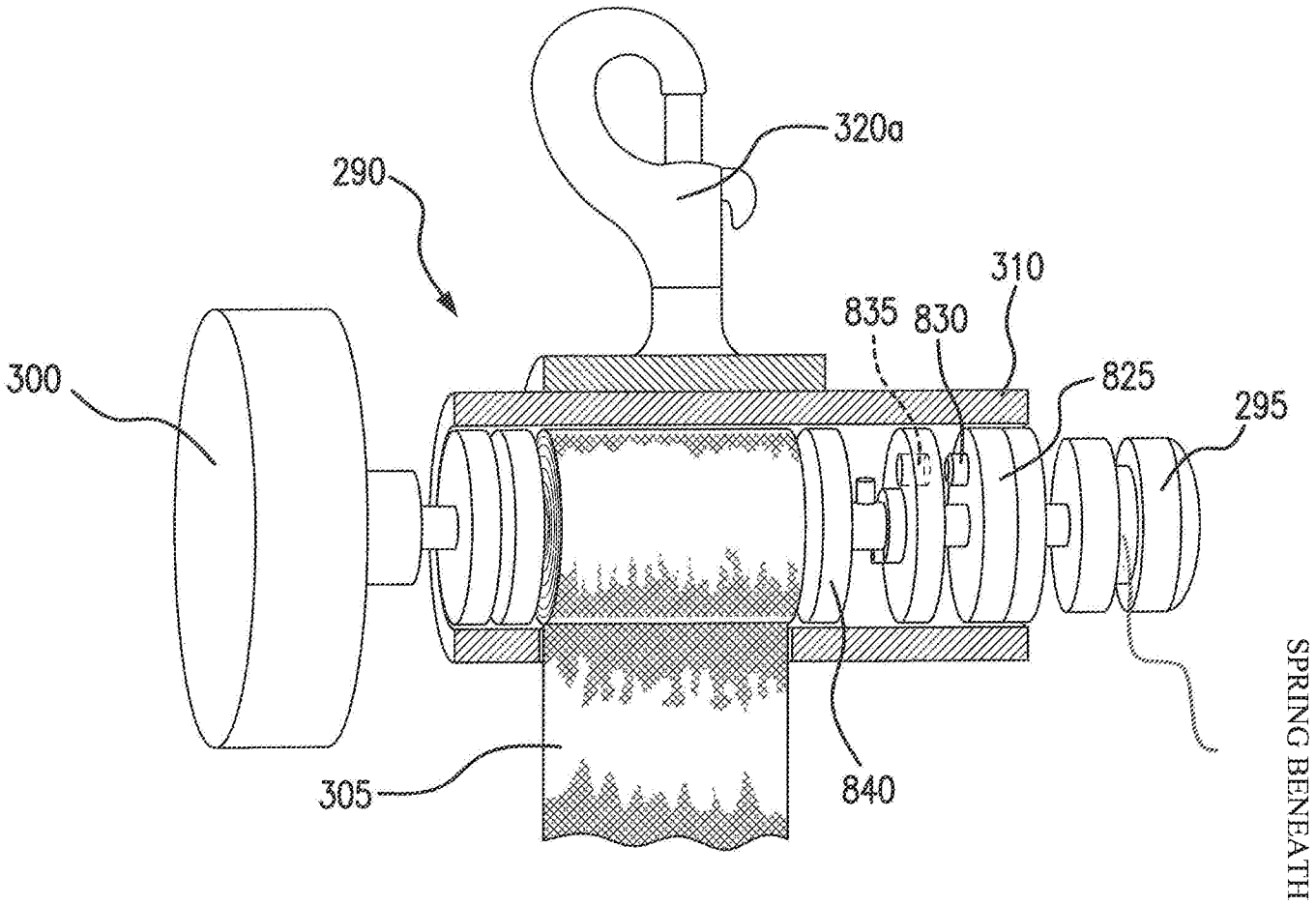
FIG. 11 is a cut away view of the strap extender depicted in FIG. 9, according to the present invention.

Referring now to FIGS. 5 through 7, there is seen various views of clamp 135 of safety accessory 100. Clamp 135 of safety accessory 100 includes a receiving plate 140 having a plate flange 155 and a receptacle 145 structured to slideably receive an elongate member 120 having a shaft 125 and handle portion 130 disposed perpendicularly to shaft 125. Plate flange 155 includes guide notches 170 structured to slideably receive guide rails 165 of an L-bracket 150 for adjusting the clamping width of clamp 135 so that side walls 235 of side rail 105 are gripped between plate flange 155 of receiving plate 140 and a bracket flange 160 of L-bracket 150. In this manner, safety accessory 100 can accommodate ladders having side rails of different widths. Proper positioning of clamp 135 on side rail 105 may be facilitated by resting one or both of placement protrusions 137 of clamp 135 on a selected one of steps 112 of step ladder 110, such as the highest or second-highest step 112 of step ladder 110, before adjusting the clamping width of clamp 135. After the clamping width is adjusted to the width of side rail 105, positioning screws 180 engage positioning nuts 181 to lock L-bracket 150 in place with respect to receiving plate 140.

Tightening screws 184 are used to tighten clamp 135 to side rail 105. For this purpose, each tightening screw 184 includes a pusher plate 190 coupled to a threaded bolt 185 screwably engaged with a threaded rail bore 210 of L-bracket 150. Each tightening screw 184 also includes a wingnut 220 and a locking nut 225 arranged in a "double-nut" configuration to lock wingnut 220 to threaded bolt 185. In this manner, rotation of wingnuts 220 along a tightening direction causes threaded bolts 185 to advance through threaded rail bores 210 toward side rail 105 to urge pusher plates 190 against an inside surface 200 of side rail 105. This, in turn, urges contact surface 215 of receiving plate 140 against an outside surface 205 of side rail 105 to effectively sandwich side rail 105 between pusher plates 190 and contact surface 215, thereby frictionally locking receiving plate 140 (and, thus, clamp 135) to side rail 105. Hexagonal nuts 195 may then be rotated along the tightening direction to urge hexagonal nuts 195 against guide rails 165, thereby preventing inadvertent loosening of threaded bolts 185. In an alternative embodiment, wingnuts 220 and locking nuts 225 are replaced with hexagonal bolt heads or screw heads formed integrally with threaded bolts 185. In this embodiment, threaded bolts 185 are rotated along the tightening direction using a wrench or a screwdriver, as the case may be. Of course, those having ordinary skill in the art will recognize that other structures may be incorporated with treaded bolts 185 to facilitate rotation of threaded bolts 185, and that various embodiments of the present invention are not intended to be limited to any particular type of structure.

Contact surface 215 of receiving plate 140 is designed to contact outside surface 205 of side rail 105 with a surface area sufficient to ensure that the frictional bond between contact surface 215 and side rail 105 maintains clamp 135 rigidly against side rail 105. To provide additional frictional bonding, contact surface 215 of receiving plate 140 and/or pusher plates 190 may be roughened or provided with surface texturing. Pusher plates 190 of tightening screws 184 may also be structured to have sufficiently large surface areas to both aid in the frictional bond between clamp 135 and side rail 105 and diffuse pressure over a larger area, thereby reducing the likelihood that tightening screws 184 will damage inside surface 200 of side rail 105 when tightened. Positioning tightening screws 184 through threaded rail bores 210 of L-bracket 150 also operates to urge guide rails 165 away from side walls 235 of side rail 105 when tightening screws 184 are operated to lock clamp 135 to side rail 105. This ensures that side walls 235 are not inadvertently bent or otherwise damaged when clamp 135 is tightened to side rail 105.

Harness 270 is comprised of a strap 275 having first and second ends 280*a*, 280*b*, each provided with a respective removable strap clip 285*a*, 285*b*. A length adjustment buckle 287 (which may be constructed of plastic and/or metal, for example) is also provided to permit the length of strap 275 to be adjusted to comfortably accommodate different sized users, such as user 115. Strap clips 285*a*, 285*b* removably couple to strap ring 132 of handle portion 130, thereby permitting strap 275 to cradle user 115 and urge him/her toward the center of gravity of step ladder 110. In this manner, user 115 is prevented from leaning too far back while standing on step ladder 110, thereby enhancing the stability of user 115 and better ensuring that step ladder 110 is not inadvertently destabilized by the weight of user 115. In an alternative embodiment, harness 270 is formed integrally and non-removeably with strap ring 132. In yet another alternative embodiment, first and second ends 280*a*, 280*b* are merged with one another (or manufactured integrally to form a continuous strap 275), and strap 275 is provided with a single removable strap clip 285 for connecting to strap ring 132.

In the alternative embodiment shown in FIGS. 8 through 11, a strap extender 290 is provided between harness 270 and strap ring 132 to permit adjustment of the distance between harness 270 and handle portion 130 of elongate member 120. Strap extender 290 includes an extender body 310 having a first coupling clip 320*a* coupled to strap ring 132 and an extender strap 305 having a second coupling clip 320*b* coupled to strap clips 285*a*, 285*b* of harness 270. Strap extender 290 also includes a strap release 295 and a retraction dial 300 connected to a spindle 840. Extender strap 305 is wrapped around spindle 840, which, in turn, is rigidly connected to a locking ring 825. Strap release 295 includes a locking nub 830 that is biased, for example, via a spring (not shown), toward a locking hole 835 of locking ring 825. When locking nub 830 is engaged with locking hole 835, spindle 840 locks to prevent extender strap 305 from being pulled out of or retracted into extender body 310. Displacement of strap release 295 along a release direction 845 and against the biasing force causes locking nub 830 to retract from locking hole 835, thereby permitting spindle 840 (with extender strap 305 thereon) to rotate freely. To increase the distance between harness 270 and handle portion 130, user 115 first pulls strap release 295 along release direction 845 from an inner position to an outer position to retract locking nub 830 from locking hole 835. While holding strap release 295 at the outer position, user 115 pulls extender strap 305 out of extender body 310 until a desired length of extender strap 305 is reached (see FIG. 10). Extender strap 305 may then be locked in place by returning strap release 295 to the inner position (which re-engages locking nub 830 within locking hole 835 of locking ring 825 to lock spindle 840 in place). To reduce the length of extender strap 305, user 115 turns retraction dial 300 along a retraction direction while holding strap release 295 at the outer position (see FIG. 9).

Figure 12:
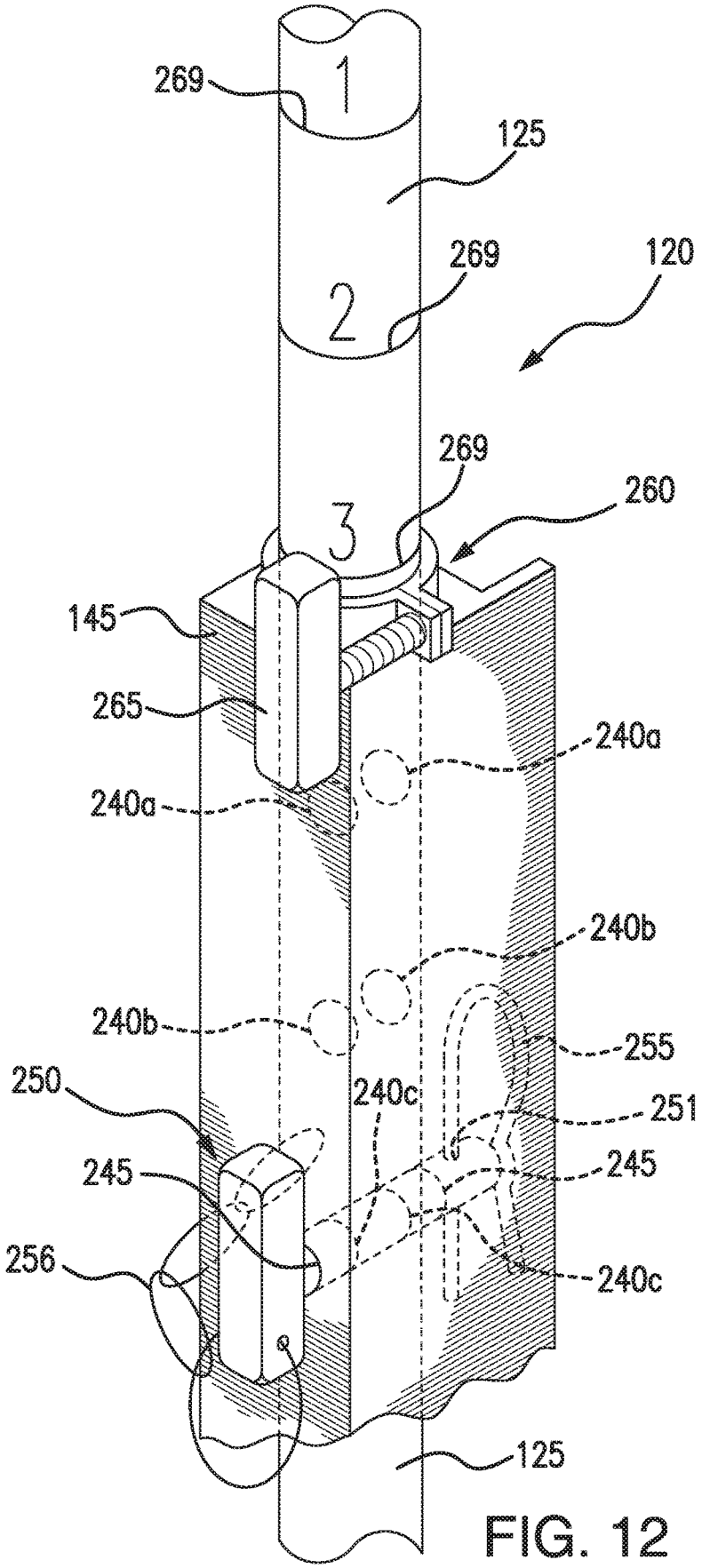
FIG. 12 is a close-up perspective view of a shaft and receptacle of the safety accessory depicted in FIG. 1, according to the present invention.
Figure 13:
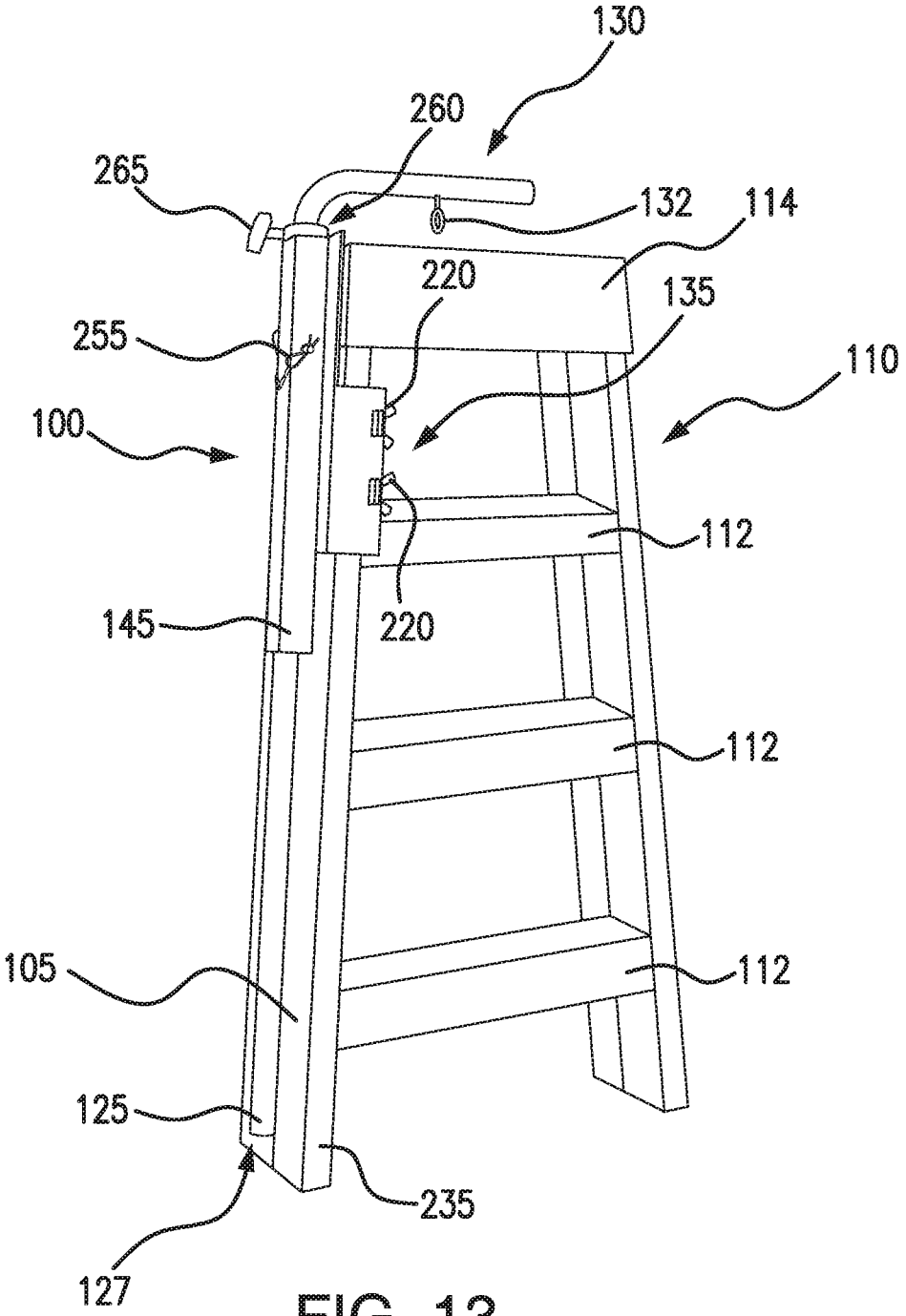
FIG. 13 is a perspective view of the safety accessory depicted in FIG. 1 attached to a step ladder in a storage position, according to the present invention.

Referring now to FIG. 12, there is seen an exemplary shaft 125 in accordance with the present invention. Shaft 125 of elongate member 120 is slideably received within receptacle 145 of clamp 135, such that handle portion 130 of elongate member 120 is positioned at a location higher than uppermost platform 114 of step ladder 110. The length of elongate member 120 with respect to clamp 135 may be adjusted to accommodate different sized users, such as user 115, or to provide a means of setting the length of elongate member 120 to multiple positions for the same user, such as when user 115 stands on different steps 112 of step ladder 110 when performing different tasks (e.g., user 115 may stand on a higher step 112 when painting a ceiling, for example, as opposed to other tasks that may be accomplished when standing on lower steps 112). Furthermore, since safety accessory 100 is mounted at an angle with respect to step ladder 110, handle portion 130 is positioned further forward of step ladder 110 as the length of elongate member 120 with respect to clamp 135 is increased. In this manner, safety accessory 100 naturally requires user 115 to lean more forward as the length of elongate member 120 is increased, thereby positioning user 115 more in line with the center of gravity of step ladder 110 and providing more stability (for example, when user 115 is standing on a higher step 112). Shaft 125 of elongate member 120 may also be locked into a fully inserted storage position within receptacle 145 to facilitate easy storage of step ladder 110 when not being used (see FIG. 13). In an alternative embodiment, shaft 125 is not lockable into the storage position and is kept in place thereat via gravity.

Shaft 125 is provided with multiple sets of length adjustment holes 240*a*, 240*b*, 240*c*, with both holes of each set being aligned and disposed 180 degrees from one another on opposite sides of shaft 125. When a selected set of length adjustment holes 240*a*, 240*b*, 240*c* is aligned with locking holes 245 on receptacle 145, a locking pin 250 may be inserted through locking holes 245 and the selected set of adjustment holes 240*a*, 240*b*, 240*c* to lock shaft 125 into a desired longitudinal position with respect to receptacle 145. A cotter pin 255 may then be inserted through a bore 251 in locking pin 250 to prevent inadvertent removal of locking pin 250 from receptacle 145 and elongate member 120. Chain 256 is also provided to keep locking pin 250 with clamp 135, so that locking pin 250 is not inadvertently misplaced or separated from safety accessory 100. A tightening ring 260 on receptacle 145 may then be adjusted via handle 265 to tighten shaft 125 into a rigid position to prevent wobbling of elongate member 120 with respect to receptacle 145 (in other embodiments, tightening ring 260 is not provided). Position markings 269 may also be disposed on shaft 125 to facilitate easy alignment of a desired set of adjustment holes 240*a*, 240*b*, 240*c* with locking holes 245. It should be appreciated that, although the present embodiment employs the use of three length adjustment holes 240*a*, 240*b*, 240*c* for setting the desired position of elongate member 120 with respect to clamp 135, various embodiments of the present invention are not intended to be limited to any particular number of length adjustment holes or any particular mechanism for adjusting the length of elongate member 120.

Figure 14:
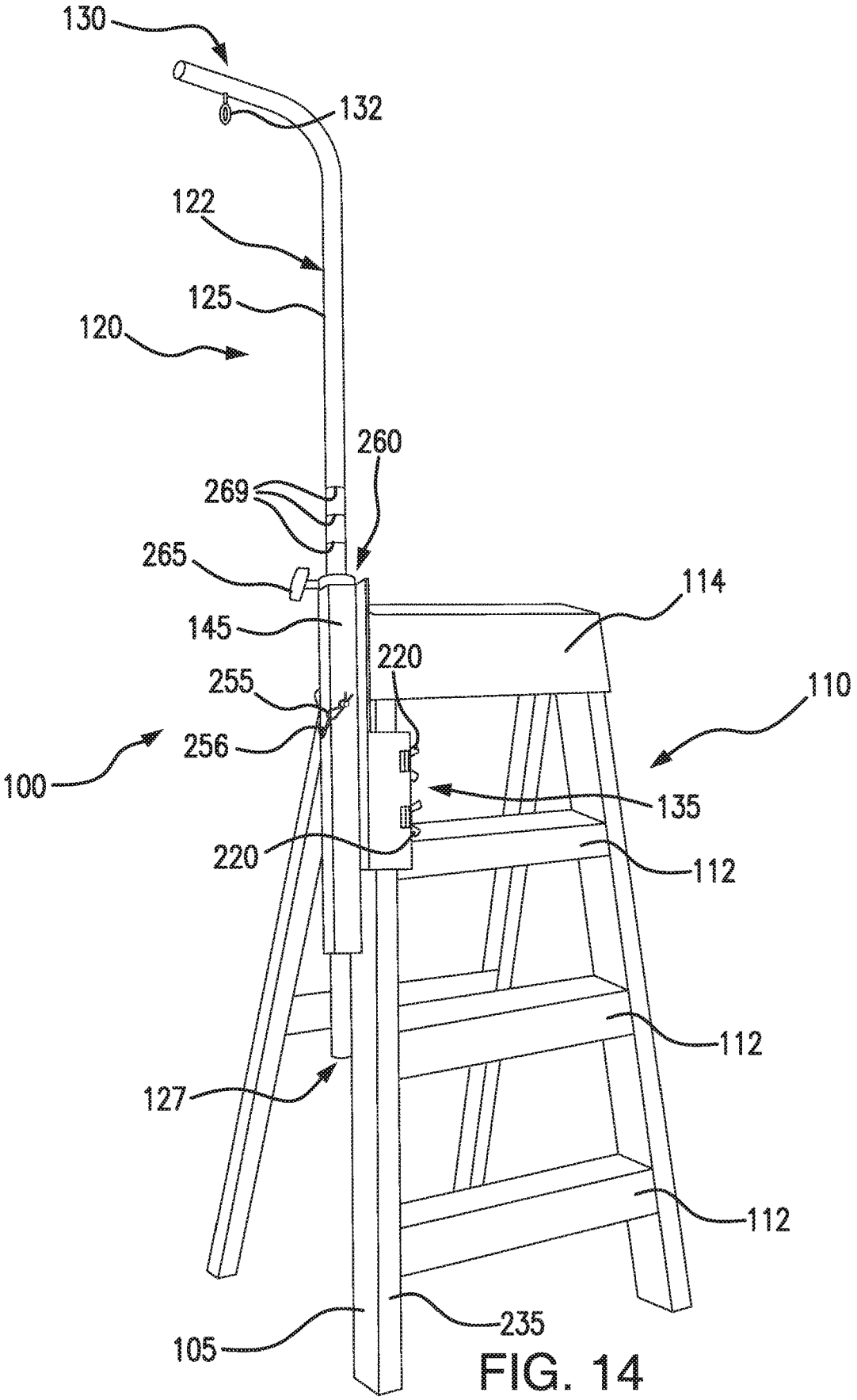
FIG. 14 is a perspective view of the safety accessory depicted in FIG. 1 with a handle portion extending on the side of a step ladder, according to the present invention.
Figure 15:
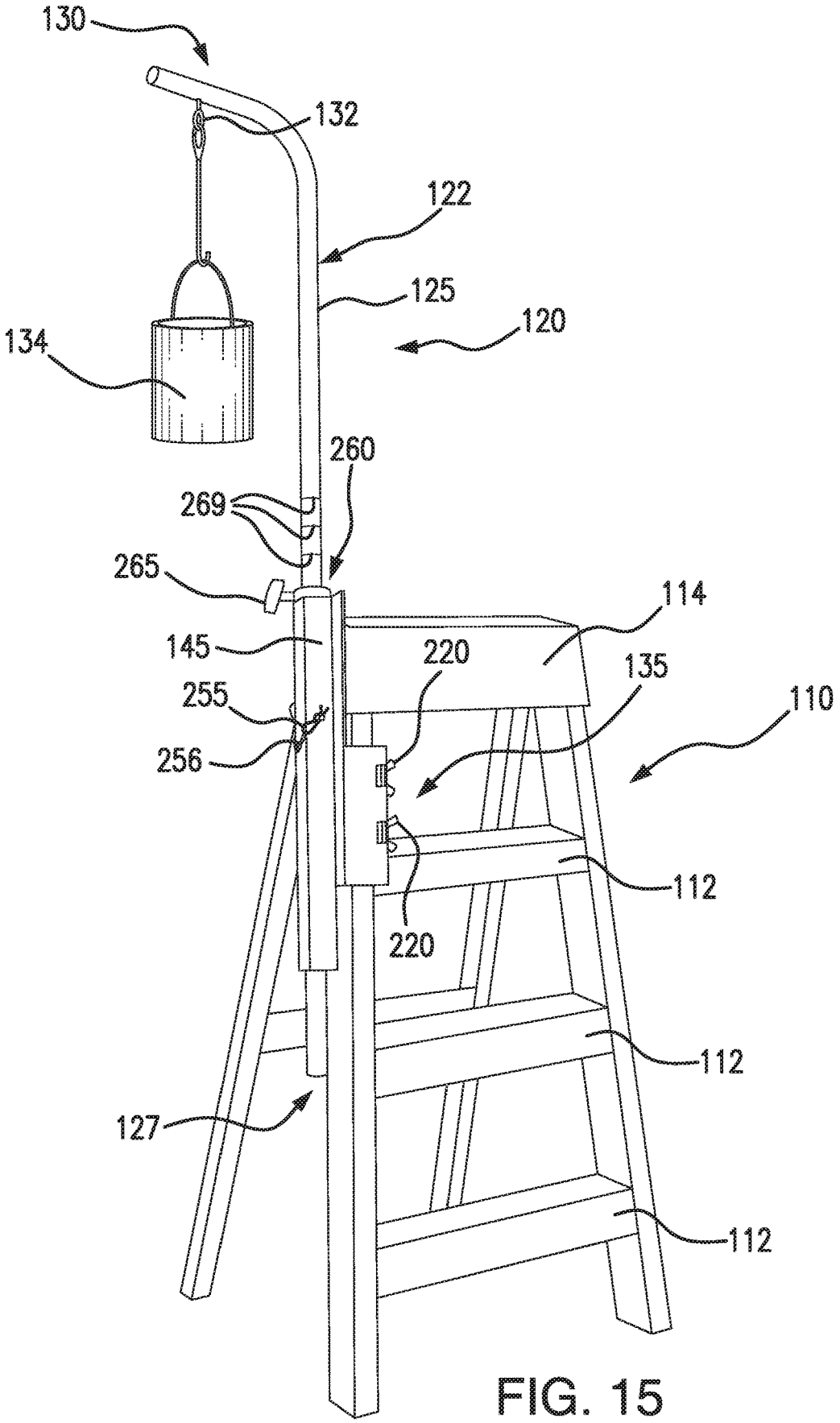
FIG. 15 is a perspective view of the safety accessory depicted in FIG. 1 with a handle portion suspending a paint can extending on the side of a step ladder, according to the present invention.

Depending on a preference of user 115 or the requirements of a particular task to be performed using step ladder 110, shaft 125 may be rotated 180 degrees before insertion of locking pin 250 to orient handle portion 130 over the side of step ladder 110 rather than directly over uppermost platform 114 (see FIG. 14). While in this position, strap ring 132 may be used, for example, to position various accessories (such as a paint can, toolbox, tools, etc.) in a convenient position for access by user 115. For example, FIG. 15 shows strap ring 132 suspending a paint can 134 for easy access by user 115. In other embodiments, additional sets of adjustment holes are provided at different angular positions around the circumference of shaft 125 to permit handle portion 130 to be oriented at multiple angular positions with respect to step ladder 110. For example, additional sets of adjustment holes may be disposed on shaft 125 at a 90-degree offset from adjustment holes 240*a*, 240*b*, 240*c*. In this manner, shaft 125 may be selectively locked into four discrete angular positions to place handle portion 130 into one of four desired orientations with respect to step ladder 110 (e.g., extending over, to the side, toward the front or toward the back of step ladder 110). Of course, it should be appreciated that other sets of adjustment holes may be added to permit handle portion 130 to be oriented into any number of desired angular orientations with respect to step ladder 110. It should also be appreciated that, although the various described embodiments depict the use of adjustment holes 240*a*, 240*b*, 240*c* and a locking pin 250 for setting the desired length of elongate member 120 with respect to clamp 135, various embodiments of the present invention are not intended to be limited to any particular mechanism for adjusting the length of elongate member 120.

Figures 16A, 16B, 16C:
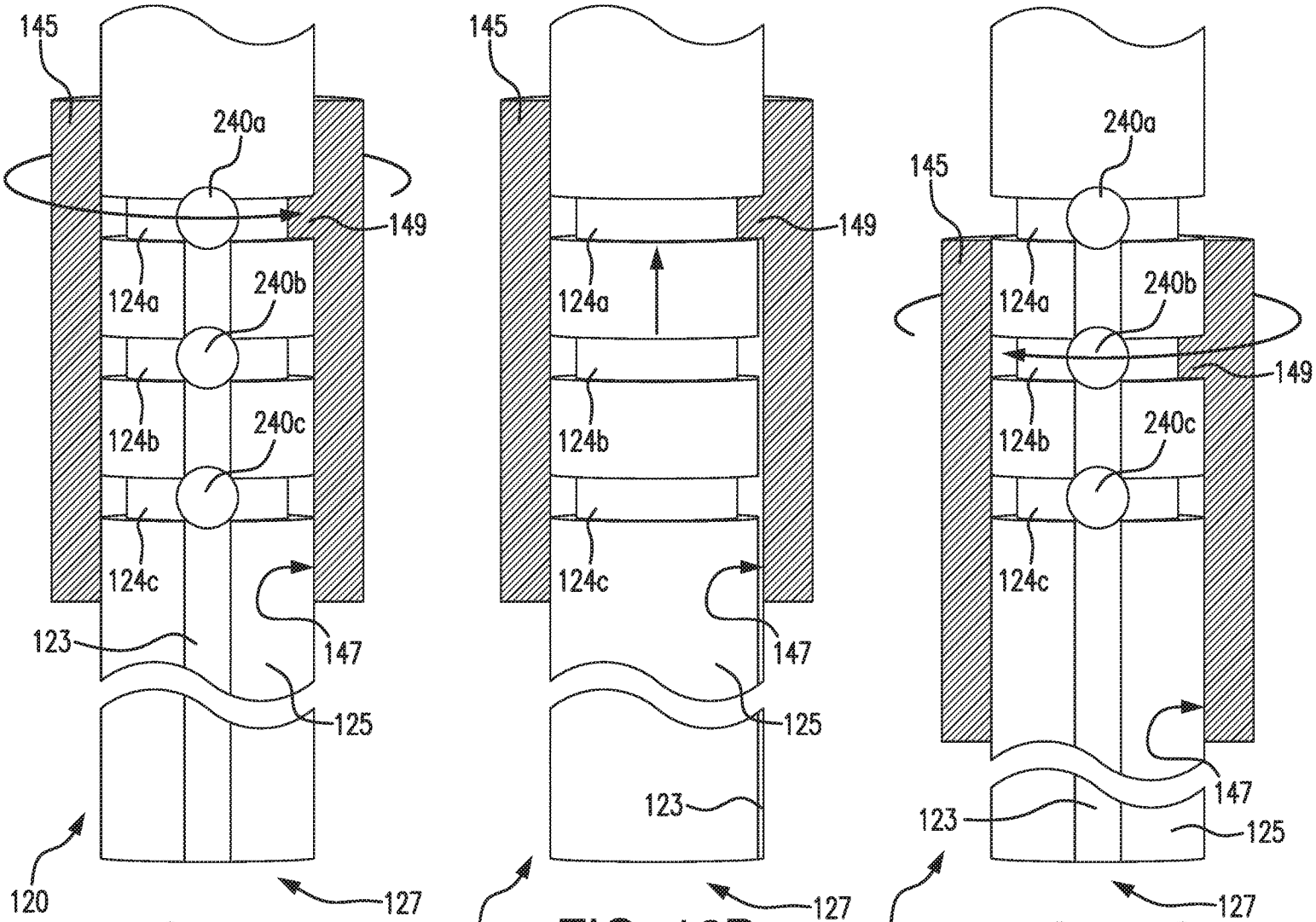
FIGS. 16Aa through 16C are various cut-away views of an alternative shaft and receptacle, according to the present invention.

Referring now to FIGS. 16A through 16C, there is seen various sectional views of an alternative elongate member 120 and receptacle 145 in accordance with the present invention. The embodiment of FIGS. 16A through 16C prevents inadvertent longitudinal displacement (or sliding) of elongate member 120 while adjusting the length of elongate member 120 with respect to clamp 135. To achieve this, inside surface 147 of receptacle 145 is provided with a guide protrusion 149 and shaft 125 of elongate member 120 is provided with a travel groove 123 disposed over adjustment holes 240*a*, 240*b*, 240*c* and extending longitudinally therefrom to distal end 127 of shaft 125. Shaft 125 is also provided with a series of circumferentially disposed grooves 124*a*, 124*b*, 124*c* corresponding to and at the same longitudinal location as adjustment holes 240*a*, 240*b*, 240*c*. To change the position of elongate member 120 with respect to clamp 135, for example, from a first position corresponding to adjustment holes 240*a* (see FIG. 16*a*) to a second position corresponding to adjustment holes 240*b* (see FIG. 16*c*), user 115 first removes locking pin 250 from locking holes 245 and adjustment holes 240*a* to free engagement member 120 for adjustment within receptacle 145. Next, user 115 rotates shaft 125 of elongate member 120 until guide protrusion 149 of receptacle 145 is aligned with travel groove 123 (see FIG. 16*b*). While shaft 125 is being rotated, engagement of guide protrusion 149 with groove 124*a* prevents shaft 125 from sliding longitudinally upwards or downwards within receptacle 145. Once guide protrusion 149 is aligned with travel groove 123, user 115 may adjust shaft 125 longitudinally to the desired position within receptacle 145 (in this example, to a position corresponding to adjustment holes 240*b*). As user 115 adjusts shaft 125 to the desired position, guide protrusion 149 traverses freely within travel groove 123. Once the desired position is reached, user 115 rotates shaft 125 to its original angular position; that is, to the angular position at which guide holes 240*b* are aligned with locking holes 245 of receptacle 145 (see FIG. 16*c*). The user then inserts locking pin 250 through locking holes 245 and adjustment holes 240*b* to lock elongate member 120 in place with respect to receptacle 145. Cotter pin 255 may then be inserted through bore 251 of locking pin 250 to prevent inadvertent removal of locking pin 250 from receptacle 145 and elongate member 120.

Since travel groove 123 extends from adjustment holes 240*a*, 240*b*, 240*c* to distal end 127 of shaft 125, insertion and removal of elongate member 120 within and from receptacle 145 (either by user 115 or during manufacturing of safety accessory 100) is made possible by aligning travel groove 123 with guide protrusion 149 while inserting/removing elongate member 120. Alternatively, travel groove 123 may be designed to extend only partially along shaft 125 so as not to terminate at distal end 127 of shaft 125. In this manner, guide protrusion 149 engaging with the terminating end of travel groove 123 prevents removal of elongate member 120 from receptacle 145. This may be desirable, for example, to ensure that elongate member 120 is not inadvertently misplaced or otherwise separated from clamp 135 while using or storing safety accessory 100. To achieve this, elongate member 120 may be pre-positioned within receptacle 145 during manufacturing of safety accessory 100 or, alternatively, by user 115, such as when receptacle 145 is constructed in sectional parts that permit pre-positioning of elongate member 120 during assembly of safety accessory 100 (for example, when safety accessory 100 is sold in a manner that requires assembly by user 115).

Referring now to FIGS. 17 through 20, there is seen a safety accessory 500 according to the present invention. Safety accessory 500 includes a clamp 535 configured to removeably attach to a selected location on side rail 105 of step ladder 110 and an adjustable length elongate member 520 having a handle portion 530 structured to be gripped by user 115 for enhancing his/her stability when standing on step ladder 110. A harness 671 similar or identical in structure and function to harness 270 described above with respect to safety accessory 100 is also provided for cradling and urging user 115 toward the center of gravity of step ladder 110, thereby further increasing stability and reducing, if not eliminating, the possibility that user 115 may inadvertently lean too far back, causing step ladder 110 to tip backwards or otherwise become unstable.

Clamp 535 of safety accessory 500 includes a receiving plate 540 having a plate flange 555, an extension shaft 627, and a receptacle 545 coupled to the extension shaft and structured to slideably receive an elongate member 520 having a shaft 525 and handle portion 530 disposed perpendicularly to shaft 525. Plate flange 555 includes guide notches 570 structured to slideably receive guide rails 565 of an L-bracket 550 for adjusting the clamping width of clamp 535 so that side walls 235 of side rail 105 are gripped between plate flange 555 of receiving plate 540 and a bracket flange 560 of L-bracket 550. In this manner, safety accessory 500 can accommodate ladders having side rails of different widths. After the clamping width is adjusted to the width of side rail 105, positioning screws 580 engage positioning nuts 581 to lock L-bracket 550 in place with respect to receiving plate 540.

Figure 20:
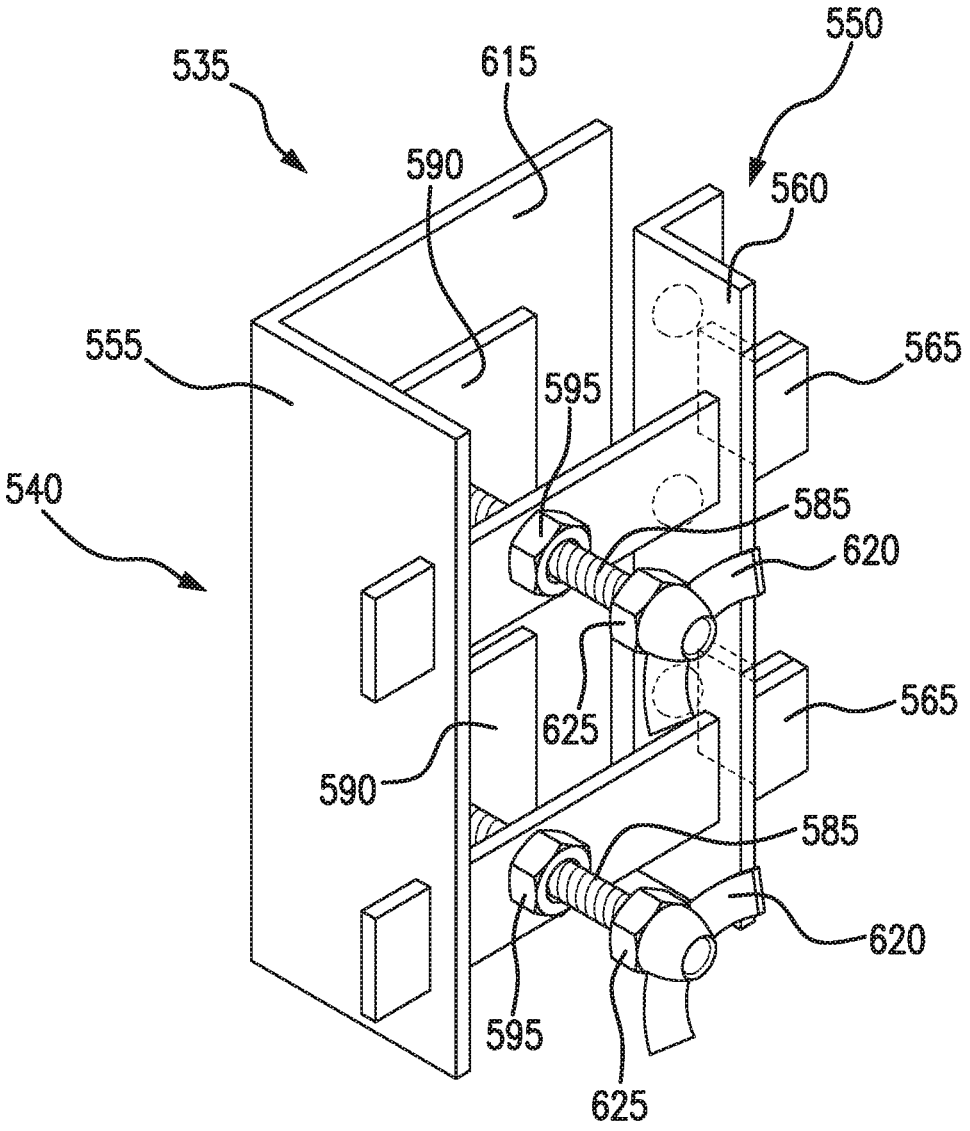
FIG. 20 is a perspective view of the clamp of the safety accessory depicted in FIG. 17, according to the present invention.

Tightening screws 584 are used to tighten clamp 535 to side rail 105. For this purpose, each tightening screw 584 includes a pusher plate 590 coupled to a threaded bolt 585 screwably engaged with threaded rail bore 610 of L-bracket 550. As shown in FIG. 20, each tightening screw 584 also includes a wingnut 620 and locking nut 625 arranged in a "double-nut" configuration to lock wingnut 620 to threaded bolt 585. In this manner, rotation of wingnuts 620 along a tightening direction causes threaded bolts 585 to advance through threaded rail bores 610 toward side rail 105 to urge pusher plates 590 against outside surface 205 of side rail 105. This, in turn, urges contact surface 615 of receiving plate 540 against side walls 235 of side rail 105 to effectively sandwich side rail 105 between pusher plates 590 and contact surface 615, thereby frictionally locking receiving plate 540 (and, thus, clamp 535) to side rail 105. To provide additional frictional bonding, pusher plates 590 of tightening screws 584 may be provided with surface texturing/roughening and/or be structured to have sufficiently large surface areas to both aid in the frictional bond and diffuse pressure over a larger area, thereby reducing the likelihood that tightening screws 584 will damage outside surface 205 of side rail 105 when tightened. Hexagonal nuts 595 may be rotated along the tightening direction to urge hexagonal nuts 595 against guide rails 565, thereby preventing inadvertent loosening of threaded bolts 585. In an alternative embodiment, wingnuts 620 and locking nuts 625 are replaced with hexagonal bolt heads or screw heads formed integrally with threaded bolts 585. In this embodiment, threaded bolts 585 are rotated along the tightening direction using a wrench or a screwdriver, as the case may be. Of course, those having ordinary skill in the art will recognize that other structures may be incorporated with treaded bolts 585 to facilitate rotation of threaded bolts 585, and that various embodiments of the present invention are not intended to be limited to any particular type of structure.

Figure 17:
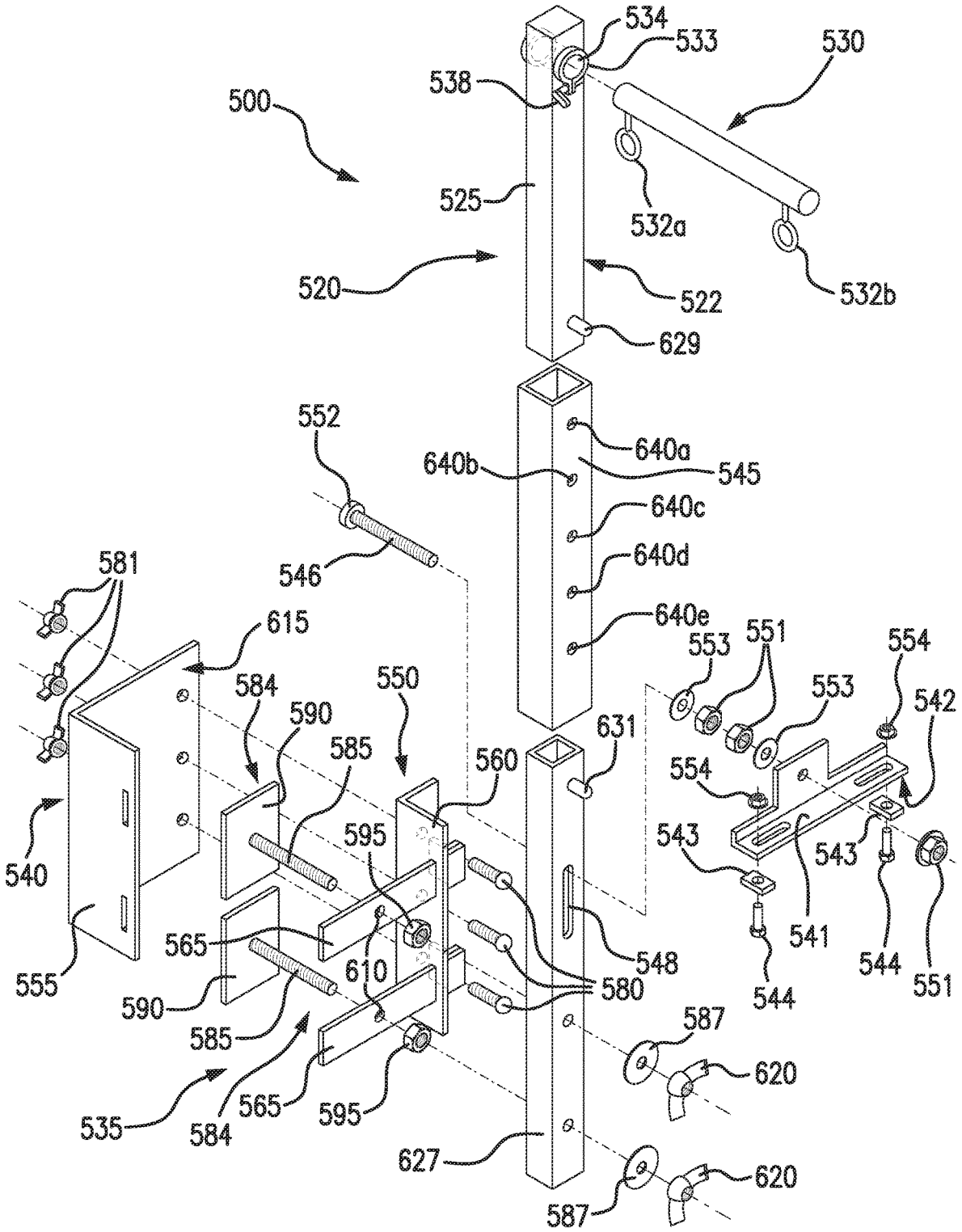
FIG. 17 is an exploded perspective view of an alternative embodiment of the safety accessory, according to the present invention.
Figure 18:
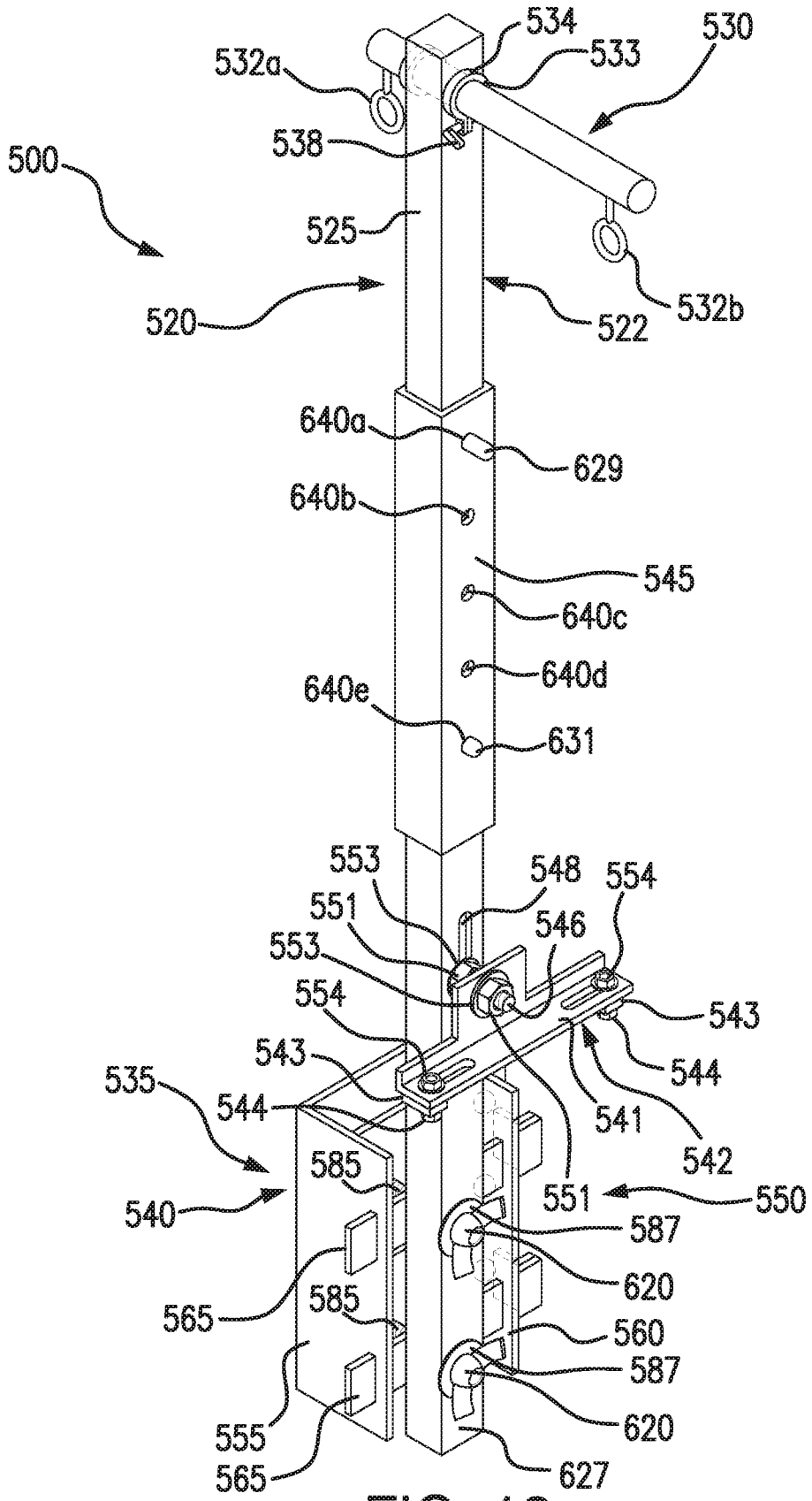
FIG. 18 is a perspective view of the safety accessory depicted in FIG. 17, according to the present invention.

After tightening hexagonal nuts 595, wingnuts 620 and locking nuts 625 are removed from threaded bolts 585, after which extension shaft 627 is slid onto threaded bolts 585 (see FIGS. 17 and 18). Extension shaft 627 is then locked to clamp 535 (while sandwiching hexagonal nuts 595) by rethreading and tightening wingnuts 620 onto threaded bolts 585 with extension washers 587.

Figure 19:
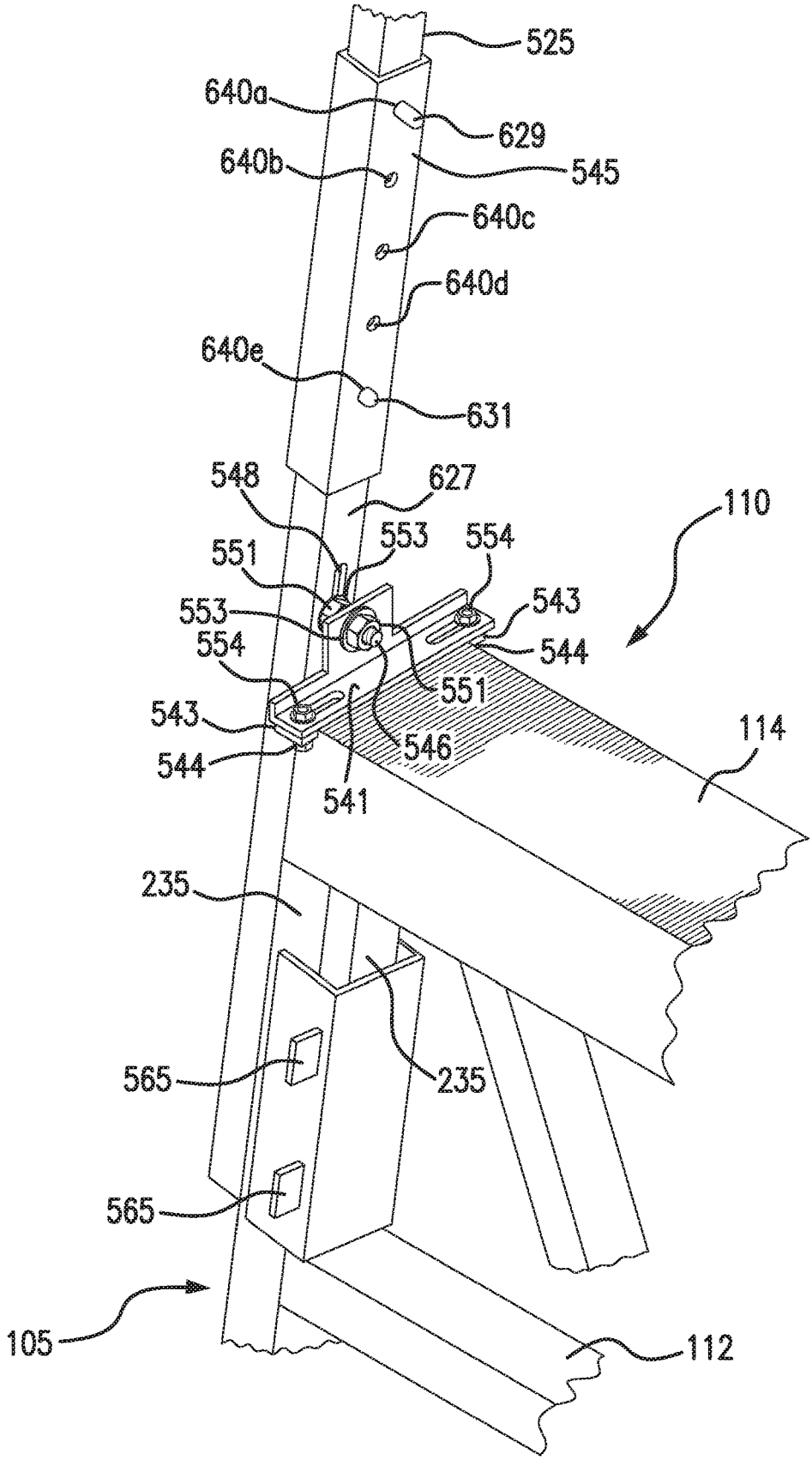
FIG. 19 is a perspective view of the safety accessory depicted in FIG. 17 attached to a step ladder, according to the present invention.

As shown best in FIGS. 17 through 19, clamp 535 also includes a stabilization bracket 541 structured to help stabilize safety accessory 500 on step ladder 110. Stabilization bracket 541 includes width adjustment blocks 543, which may be adjusted via adjustment screws 544 and nuts 554 to the width of uppermost platform 114 of step ladder 110. In this way, width adjustment blocks 543 ensure that stabilization bracket 541 straddles uppermost platform 114 in snug fashion and does not slide or otherwise displace widthwise while resting thereon. The vertical position of stabilization bracket 541 may also be adjusted to ensure that bottom surface 542 of stabilization bracket 541 rests firmly on uppermost platform 114. For this purpose, stabilization bracket 541 is provided with a height adjustment bolt 546 slideably received within a height adjustment groove 548 of extension shaft 627 and prevented from removal therefrom via bolt head 552. In this manner, height adjustment bolt 546 may be slid to the proper position within height adjustment groove 548 to adjust the vertical position of stabilization bracket 541 to the height of uppermost platform 114 of step ladder 110. Once adjusted to the proper vertical position, stabilization bracket 541 may be locked in place using locking nuts 551 and washers 553.

Shaft 525 of elongate member 520 is slideably received within receptacle 545 of clamp 535, such that handle portion 530 of elongate member 520 is positioned at a location higher than uppermost platform 114 of step ladder 110. The length of elongate member 520 with respect to clamp 535 may be adjusted to accommodate different sized users, such as user 115, or to provide a means of setting the length of elongate member 520 to multiple positions for the same user 115, such as when user 115 stands on different steps 112 of step ladder 110 when performing different tasks. Furthermore, since safety accessory 500 is mounted at an angle with respect to step ladder 110, handle portion 530 is positioned further forward of step ladder 110 as the length of elongate member 520 with respect to clamp 535 is increased. In this manner, safety accessory 500 naturally requires user 115 to lean more forward as the length of elongate member 520 is increased, thereby positioning user 115 more in line with the center of gravity of step ladder 110 and providing more stability (for example, when user 115 is standing on a higher step 112). Shaft 525 of elongate member 520 may also be locked into a fully inserted storage position within receptacle 545 to facilitate easy storage of step ladder 110 when not being used. In an alternative embodiment, shaft 525 is not lockable into the storage position and is kept in place thereat via gravity.

Shaft 525 of elongate member 520 is provided with a length adjustment button 629 biased radially outwardly from shaft 525, such as, for example, via a spring (not shown). Receptacle 545 is provided with a series of longitudinally disposed length adjustment holes 640*a*, 640*b*, 640*c*, . . . 640*e*. To adjust the length of elongate member 520 with respect to clamp 535, user 115 depresses length adjustment button 629 and slides elongate member 520 longitudinally within receptacle 545 to the desired position. Once the desired position is reached, the biasing force on length adjustment button 629 will cause it to "pop" into the appropriate one of length adjustment holes 640*a*, 640*b*, 640*c*, . . . 640*e*, thereby maintaining elongate member 520 in place within receptacle 545 at the desired position. Position markings may also be disposed on shaft 525 to facilitate easy adjustment of elongate member 520 within receptacle 545. Extension shaft 627 may also be provided with an extension button 631 biased radially outwardly from extension shaft 627, such as, for example, via a spring (not shown). In this embodiment, the position of receptacle 545 with respect to extension shaft 627 may be adjusted similarly to shaft 525. It should also be appreciated that, although the present embodiment employs the use of length adjustment button 629 and six length adjustment holes 640*a*, 640*b*, 640*c*, . . . 640*e* for setting the desired position of elongate member 520 with respect to clamp 535, various embodiments of the present invention are not intended to be limited to any particular number of length adjustment holes or any particular mechanism for adjusting the length of elongate member 520.

Figure 21B:
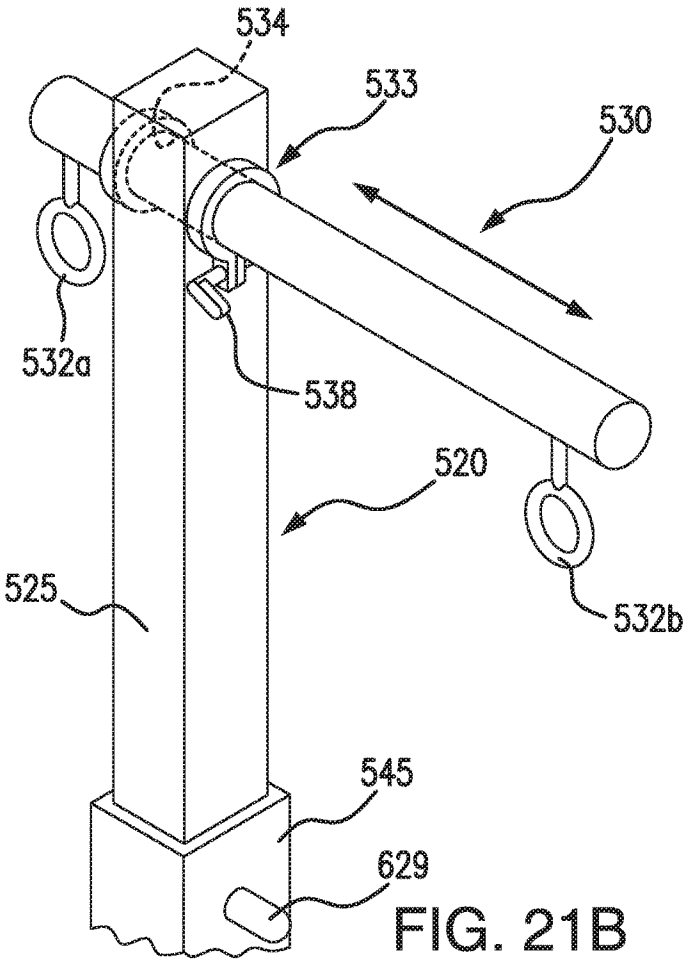
FIGS. 21A and 21B are perspective views of a handle portion of the safety accessory depicted in FIG. 17, according to the present invention.
Figure 21A:
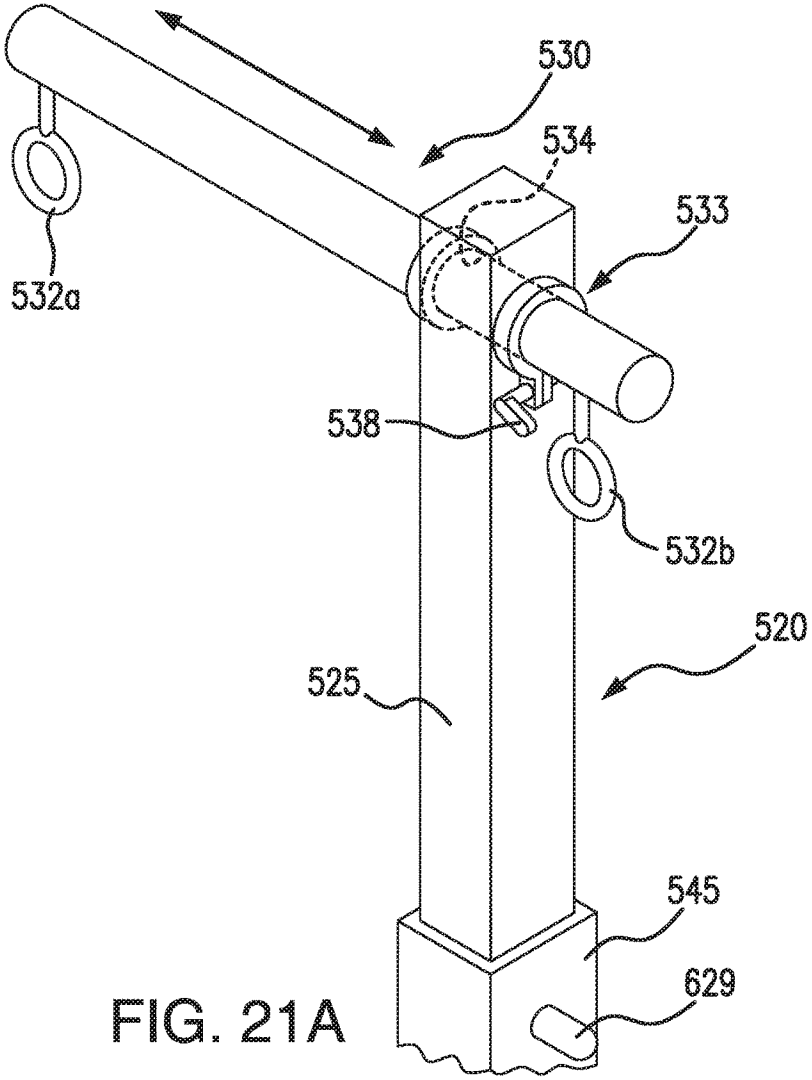

Referring now to FIGS. 21Aa and 21Bb, there is seen closeup views of handle portion 530 in various orientations. Handle portion 530 includes two strap rings 532*a*, 532*b* at respective ends thereof. Handle tightener 533 keeps handle portion 530 in place rigidly within handle receptacle 534 of elongate member 520. In the orientation shown in FIG. 21B, strap ring 532*b* may be used to couple to a harness (such as harness 671) or strap extender similar or identical in structure and function to harness 270 and strap extender 290 described above with respect to safety accessory 100. As shown in FIG. 21A, handle portion 530 may be adjusted to extend to the side of step ladder 110 by first loosening handle tightener 533 via knob 538, sliding handle portion 530 within handle receptacle 534 toward the side of step ladder 110, and relocking handle tightener 533. In this orientation, strap ring 532*a* may be used, for example, to position various accessories (such as a paint can, toolbox, tools, etc.) in a convenient position for access by user 115. In an alternative embodiment, handle tightener 533 is dispensed with entirely, and handle portion 530 is kept permanently in place at a desired orientation with respect to elongate member 520. In still another embodiment, handle portion 530 is formed integrally with shaft 525 of elongate member 520 and also kept permanently in place at a desired orientation with respect to elongate member 520.

Figure 22:
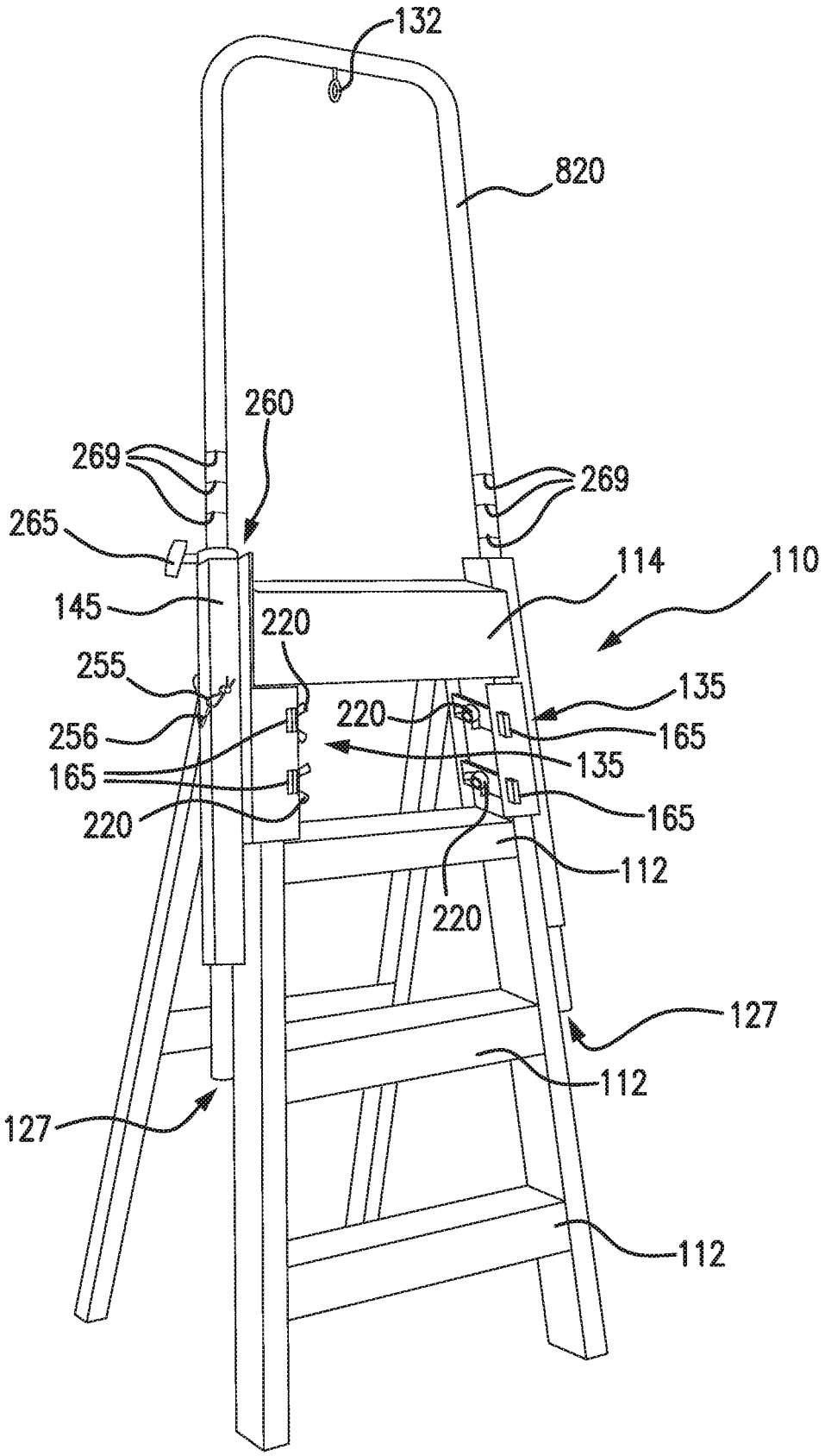
FIG. 22 is a perspective view of an alternative safety accessory with a U-shaped elongate member, according to the present invention.

Safety accessories 100 and 500 are reversible to accommodate the preferences of user 115, in that each of accessories 100 and 500 may be mounted on either the left or right side of step ladder 110. In one embodiment, two safety accessories are mounted on opposite sides of step ladder 110. For example, two safety accessories 100 may be mounted on opposite sides of step ladder 110. In this embodiment, a single elongate member 120 may be selectively inserted within either safety accessory 100 depending on the preferences of user 115 or the requirements of a particular task to be performed using step ladder 110. In another embodiment, two elongate members 120 may be inserted at the same time within both safety accessories 100. In yet another embodiment (see FIG. 22), a single length-adjustable U-shaped elongate member 820 is inserted into both safety accessories 100. It should be appreciated that a single U-shaped elongate member may also be employed with respect to an embodiment employing two safety accessories 500 or other safety accessories contemplated by the present invention.

The invention includes a safety accessory for stabilizing a user on a step ladder having an uppermost platform, a plurality of steps, at least one side rail, and a center of gravity, the safety accessory comprising:

an elongate member having a shaft and at least one handle portion extending perpendicularly to the shaft and structured to be gripped by the user, the handle portion having a strap ring;

a harness configured to removeably couple to the strap ring of the handle portion, the harness being structured to cradle and urge the user toward the center of gravity of the step ladder when the user stands on at least one of the plurality of steps of the step ladder; and a clamp configured to removeably attach to a selected location on the side rail of the step ladder, the clamp having a receptacle structured to slideably receive the shaft of the elongate member and a positioning structure configured to maintain the shaft of the elongate member into a selected one of a plurality of longitudinal positions with respect to the clamp;

wherein the handle portion of the elongate member is positioned above the uppermost platform of the step ladder when the shaft of the elongate member is extended into the selected longitudinal position with respect to the clamp, wherein the user is stabilized on the step ladder when the user grips the handle portion of the elongate member.

The invention further includes the safety accessory of paragraph 66, wherein the clamp includes:

a receiving plate having a plate flange and at least one guide notch, an L-bracket having a bracket flange and at least one guide rail, the guide notch of the receiving plate being configured to slideably receive the guide rail of the L-bracket for adjusting a clamping distance between the plate flange and the bracket flange, the clamping distance being adjustable to a width of the side rail for gripping the side rail between the plate flange and the bracket flange; and at least one positioning screw configured to lock the L-bracket to the receiving plate after the clamping distance is adjusted to the width of the side rail.

The invention further includes the safety accessory of paragraph 67, wherein the at least one guide rail includes a threaded rail bore, the clamp further including at least one tightening screw, the tightening screw having:

a threaded bolt with first and second ends, the threaded bolt being screwably disposed through the threaded rail bore;

a pusher plate coupled to the first end of the threaded bolt;

a wingnut screwably engaged with the threaded bolt adjacent to the second end of the threaded bolt;

a locking nut screwably engaged with the threaded bolt adjacent to the wingnut, the locking nut and the wingnut being arranged in a double-nut configuration; and a hexagonal nut screwably engaged with the threaded bolt adjacent to the locking nut;

wherein rotation of the threaded bolt along a tightening direction causes the pusher plate to advance toward and frictionally engage an inside surface of the side rail of the step ladder to sandwich the side rail between the receiving plate and the pusher plate, wherein rotation of the hexagonal nut along a tightening direction causes the hexagonal nut to advance toward the guide rail.

The invention further includes the safety accessory of paragraph 66, wherein the clamp includes at least one placement protrusion structured to rest on one of the plurality of steps of the step ladder to assist with positioning of the clamp when the clamp is removeably attached to the selected location on the side rail of the ladder.

The invention further includes the safety accessory of paragraph 66, wherein the shaft of the elongate member includes a plurality of length adjustment holes, the receptacle of the clamp includes at least one locking hole, and the positioning structure of the clamp includes:

a locking pin having a transverse bore, the locking pin structured to be removeably inserted through the locking hole and a selected set of the length adjustment holes to position the shaft into the selected longitudinal position with respect to the clamp;

a cotter pin structured to be inserted into the transverse bore of the locking pin for preventing removal of the locking pin from the locking hole and the selected set of length adjustment holes; and a chain having first and second ends, the first end of the chain being coupled to the locking pin, the second end of the chain being coupled to the receptacle, the chain structured to maintain the locking pin with the receptacle when the locking pin is not inserted through the locking hole and the selected set of length adjustment holes.

The invention further includes the safety accessory of paragraph 70, wherein the positioning structure of the clamp further includes a tightening ring configured to be tightened around the shaft of the elongate member for rigidly maintaining the shaft of the elongate member within the receptacle of the clamp.

The invention further includes the safety accessory of paragraph 70, wherein the shaft of the elongate member includes a plurality of markings corresponding to the plurality of longitudinal positions.

The invention further includes the safety accessory of paragraph 70, wherein the handle portion extends toward the uppermost platform of the step ladder.

The invention further includes the safety accessory of paragraph 70, wherein insertion of the locking pin through the locking hole and a selected set of the length adjustment holes positions the shaft into a selected one of a plurality of angular positions with respect to the clamp.

The invention further includes the safety accessory of paragraph 74, wherein one of the plurality of angular positions includes an angular position at which the handle portion of the elongate member extends over a side of the step ladder.

The invention further includes the safety accessory of paragraph 75, wherein the strap ring of the handle portion is configured to hold at least one user accessory.

The invention further includes the safety accessory of paragraph 76, wherein the at least one user accessory includes a paint can.

The invention further includes the safety accessory of paragraph 70, wherein an inside surface of the receptacle includes a guide protrusion and an outside surface of the shaft of the elongate member includes a travel groove extending longitudinally along the shaft and a plurality of circumferentially disposed placement grooves corresponding to the plurality of length adjustment holes, wherein engagement of the guide protrusion with a selected one of the placement grooves prevents longitudinal displacement of the shaft with respect to the receptacle, and engagement of the guide protrusion with the travel groove permits longitudinal displacement of the shaft with respect to the receptacle.

The invention further includes the safety accessory of paragraph 66, wherein the harness includes:

a strap having a first end, a second end and a length;

a first strap clip coupled to the first end of the strap;

a second strap clip coupled to the second end of the strap, the first and second strap clips being configured to be removeably coupled to the strap ring of the handle portion; and a length adjustment buckle structured to permit adjustment of the length of the strap.

The invention further includes a safety accessory for stabilizing a user on a step ladder having an uppermost platform, a plurality of steps, at least one side rail, and a center of gravity, the safety accessory comprising:

an elongate member having a shaft and at least one handle portion extending perpendicularly to the shaft and structured to be gripped by the user, the handle portion having a strap ring;

a strap extender including an extender body, an extender strap extending from the extender body, a first coupling clip attached to the extender strap, a second coupling clip attached to the extender body, the second coupling clip being configured to removeably attach to the strap ring of the handle portion, the strap extender being configured to permit adjustment of a length of the extender strap;

a harness configured to removeably couple to the first coupling clip of the strap extender, the harness being structured to cradle and urge the user toward the center of gravity of the step ladder when the user stands on at least one of the plurality of steps of the step ladder; and a clamp configured to removeably attach to a selected location on the side rail of the step ladder, the clamp having a receptacle structured to slideably receive the shaft of the elongate member and a positioning structure configured to maintain the shaft of the elongate member into a selected one of a plurality of longitudinal positions with respect to the clamp;

wherein the handle portion of the elongate member is positioned above the uppermost platform of the step ladder when the shaft of the elongate member is extended into the selected longitudinal position with respect to the clamp, wherein the user is stabilized on the step ladder when the user grips the handle portion of the elongate member.

The invention further includes the safety accessory of paragraph 80, wherein the clamp includes:

a receiving plate having a plate flange and at least one guide notch, an L-bracket having a bracket flange and at least one guide rail, the guide notch of the receiving plate being configured to slideably receive the guide rail of the L-bracket for adjusting a clamping distance between the plate flange and the bracket flange, the clamping distance being adjustable to a width of the side rail for gripping the side rail between the plate flange and the bracket flange; and at least one positioning screw configured to lock the L-bracket to the receiving plate after the clamping distance is adjusted to the width of the side rail.

The invention further includes the safety accessory of paragraph 81, wherein the at least one guide rail includes a threaded rail bore, the clamp further including at least one tightening screw, the tightening screw having a threaded bolt with first and second ends, the threaded bolt being screwably disposed through the threaded rail bore;

a pusher plate coupled to the first end of the threaded bolt;

a wingnut screwably engaged with the threaded bolt adjacent to the second end of the threaded bolt;

a locking nut screwably engaged with the threaded bolt adjacent to the wingnut, the locking nut and the wingnut being arranged in a double-nut configuration; and a hexagonal nut screwably engaged with the threaded bolt adjacent to the locking nut;

wherein rotation of the threaded bolt along a tightening direction causes the pusher plate to advance toward and frictionally engage an inside surface of the side rail of the step ladder to sandwich the side rail between the receiving plate and the pusher plate, wherein rotation of the hexagonal nut along a tightening direction causes the hexagonal nut to advance toward the guide rail.

The invention further includes the safety accessory of paragraph 80, wherein the clamp includes at least one placement protrusion structured to rest on one of the plurality of steps of the step ladder to assist with positioning of the clamp when the clamp is removeably attached to the selected location on the side rail of the ladder.

The invention further includes the safety accessory of paragraph 80, wherein the shaft of the elongate member includes a plurality of length adjustment holes, the receptacle of the clamp includes at least one locking hole, and the positioning structure of the clamp includes a locking pin having a transverse bore, the locking pin structured to be removeably inserted through the locking hole and a selected set of the length adjustment holes to position the shaft into the selected longitudinal position with respect to the clamp;

a cotter pin structured to be inserted into the transverse bore of the locking pin for preventing removal of the locking pin from the locking hole and the selected set of length adjustment holes; and a chain having first and second ends, the first end of the chain being coupled to the locking pin, the second end of the chain being coupled to the receptacle, the chain structured to maintain the locking pin with the receptacle when the locking pin is not inserted through the locking hole and the selected set of length adjustment holes.

The invention further includes the safety accessory of paragraph 84, wherein the positioning structure of the clamp further includes a tightening ring configured to be tightened around the shaft of the elongate member for rigidly maintaining the shaft of the elongate member within the receptacle of the clamp.

The invention further includes the safety accessory of paragraph 84, wherein the shaft of the elongate member includes a plurality of markings corresponding to the plurality of longitudinal positions.

The invention further includes the safety accessory of paragraph 84, wherein the handle portion extends toward the uppermost platform of the step ladder.

The invention further includes the safety accessory of paragraph 84, wherein insertion of the locking pin through the locking hole and a selected set of the length adjustment holes positions the shaft into a selected one of a plurality of angular positions with respect to the clamp.

The invention further includes the safety accessory of paragraph 88, wherein one of the plurality of angular positions includes an angular position at which the handle portion of the elongate member extends over a side of the step ladder.

The invention further includes the safety accessory of paragraph 89, wherein the strap ring of the handle portion is configured to hold at least one user accessory.

The invention further includes the safety accessory of paragraph 90, wherein the at least one user accessory includes a paint can.

The invention further includes the safety accessory of paragraph 84, wherein an inside surface of the receptacle includes a guide protrusion and an outside surface of the shaft of the elongate member includes a travel groove extending longitudinally along the shaft and a plurality of circumferentially disposed placement grooves corresponding to the plurality of length adjustment holes, wherein engagement of the guide protrusion with a selected one of the placement grooves prevents longitudinal displacement of the shaft with respect to the receptacle, and engagement of the guide protrusion with the travel groove permits longitudinal displacement of the shaft with respect to the receptacle.

The invention further includes the safety accessory of paragraph 84, wherein the harness includes:

a strap having a first end, a second end and a length;

a first strap clip coupled to the first end of the strap;

a second strap clip coupled to the second end of the strap, the first and second strap clips being configured to be removeably coupled to first coupling clip of the strap extender; and a length adjustment buckle structured to permit adjustment of the length of the strap.

The invention further includes a safety accessory for stabilizing a user on a step ladder having an uppermost platform, a plurality of steps, at least one side rail, and a center of gravity, the safety accessory comprising:

an elongate member having a shaft and at least one handle portion extending perpendicularly to the shaft and structured to be gripped by the user, the handle portion having a strap ring;

a harness configured to removeably couple to the strap ring of the handle portion, the harness being structured to cradle and urge the user toward the center of gravity of the step ladder when the user stands on at least one of the plurality of steps of the step ladder;

a clamp configured to removeably attach to a selected location on the side rail of the step ladder, the clamp having an extender bar and a receptacle coupled to the extender bar, the extender bar including a height adjustment groove, the receptacle being structured to slideably receive the shaft of the elongate member, the clamp further having a positioning structure configured to maintain the shaft of the elongate member into a selected one of a plurality of longitudinal positions with respect to the clamp; and a stabilization bracket having a bottom surface structured to rest on the uppermost platform of the step ladder, a height adjustment bolt structured to slideably engage with the height adjustment groove of the extender bar, a plurality of width adjustment blocks for straddling the uppermost platform; and a plurality of locking nuts for locking the stabilization bracket in place with respect to the clamp and the uppermost platform;

wherein the handle portion of the elongate member is positioned above the uppermost platform of the step ladder when the shaft of the elongate member is extended into the selected longitudinal position with respect to the clamp, wherein the user is stabilized on the step ladder when the user grips the handle portion of the elongate member.

The invention further includes the safety accessory of paragraph 94, wherein the clamp includes:

a receiving plate having a plate flange and at least one guide notch, an L-bracket having a bracket flange and at least one guide rail, the guide notch of the receiving plate being configured to slideably receive the guide rail of the L-bracket for adjusting a clamping distance between the plate flange and the bracket flange, the clamping distance being adjustable to a width of the side rail for gripping the side rail between the plate flange and the bracket flange; and at least one positioning screw configured to lock the L-bracket to the receiving plate after the clamping distance is adjusted to the width of the side rail.

The invention further includes the safety accessory of paragraph 95, wherein the at least one guide rail includes a threaded rail bore, the clamp further including at least one tightening screw, the tightening screw having:

a threaded bolt with first and second ends, the threaded bolt being slideably disposed through the extender bar and screwably disposed through the threaded rail bore;

a pusher plate coupled to the first end of the threaded bolt;

a wingnut screwably engaged with the threaded bolt adjacent to the second end of the threaded bolt;

a washer positioned on the threaded bolt adjacent to the wingnut; and a hexagonal nut screwably engaged with the threaded bolt between the guide rail and the extender bar;

wherein rotation of the threaded bolt along a tightening direction causes the pusher plate to advance toward and frictionally engage an outside surface of the side rail of the step ladder to sandwich the side rail between the receiving plate and the pusher plate, wherein rotation of the hexagonal nut along a tightening direction causes the hexagonal nut to advance toward the guide rail.

The invention further includes the safety accessory of paragraph 96, wherein the receptacle includes a plurality of length adjustment holes, and the positioning structure includes a length adjustment button biased radially outwardly from the shaft of the elongate member, wherein the length adjustment button is structured to be removeably positioned within a selected one of the length adjustment holes for maintaining the shaft of the elongate member in the selected longitudinal position with respect to the clamp, and the length adjustment button is configured to be depressed to permit the shaft to move to another one of the plurality of longitudinal positions with respect to the clamp.

The invention further includes the safety accessory of paragraph 96, wherein the shaft of the elongate member includes a plurality of markings corresponding to the plurality of longitudinal positions.

The invention further includes the safety accessory of paragraph 96, wherein the strap ring of the handle portion is configured to hold at least one user accessory.

The invention further includes the safety accessory of paragraph 99, wherein the at least one user accessory includes a paint can.

The invention further includes the safety accessory of paragraph 94, wherein the harness includes:

a strap having a first end, a second end and a length;

a first strap clip coupled to the first end of the strap;

a second strap clip coupled to the second end of the strap, the first and second strap clips being configured to be removeably coupled to the strap ring of the handle portion; and a length adjustment buckle structured to permit adjustment of the length of the strap.

The invention further includes a safety accessory for stabilizing a user on a step ladder having an uppermost platform, a plurality of steps, a left side rail, a right side rail, and a center of gravity, the safety accessory comprising:

a first clamp configured to removeably attach to the left side rail of the step ladder, the first clamp having a first receptacle and a first positioning structure;

a second clamp configured to removeably attach to the right side rail of the step ladder, the second clamp having a second receptacle and a second positioning structure;

a U-shaped elongate member having a left shaft, a right shaft, and a handle portion extending perpendicularly to the left and right shafts and having a strap ring, the handle portion structured to be gripped by the user, the first receptacle of the first clamp structured to slideably receive the left shaft of the elongate member; the second receptacle of the second clamp structured to slideably receive the right shaft of the elongate member; the first positioning structure being configured to maintain the left shaft of the elongate member into a selected one of a plurality of longitudinal positions; the second positioning structure being configured to maintain the right shaft of the elongate member into the selected one of the plurality of longitudinal positions; and a harness configured to removeably couple to the strap ring of the handle portion, the harness being structured to cradle and urge the user toward the center of gravity of the step ladder when the user stands on at least one of the plurality of steps of the step ladder; wherein the handle portion of the elongate member is positioned above the uppermost platform of the step ladder when the left and right shafts of the elongate member are extended into the selected longitudinal position, wherein the user is stabilized on the step ladder when the user grips the handle portion of the elongate member.

While the present invention has been illustrated by description of various embodiments and while those embodiments have been described in considerable detail, it is not the intention of Applicant to restrict or in any way limit the scope of the invention to such details. Additional advantages and modifications will readily appear to those skilled in the art. The invention in its broader aspects is therefore not limited to the specific details and illustrative examples shown and described. Departures may be made from such details without departing from the spirit or scope of the invention.

I claim:

1. A safety accessory for stabilizing a user on a step ladder having an uppermost platform, a plurality of steps, and at least one side rail, the safety accessory comprising:

an elongate member having a shaft and at least one handle portion extending perpendicularly to the shaft and structured to be gripped by the user, the handle portion having a strap ring;

a harness configured to removeably couple to the strap ring of the handle portion; and a clamp configured to removeably attach to a selected location on a side rail of a step ladder, the clamp having:

a receptacle structured to slideably receive the shaft of the elongate member and a positioning structure configured to maintain the shaft of the elongate member into a selected one of a plurality of longitudinal positions with respect to the clamp, a receiving plate having a plate flange and at least one guide notch, an L-bracket having a bracket flange and at least one guide rail, the guide notch of the receiving plate being configured to slideably receive the guide rail of the L-bracket for adjusting a clamping distance between the plate flange and the bracket flange, the clamping distance being adjustable to a width of the side rail for gripping the side rail between the plate flange and the bracket flange; and at least one positioning screw configured to lock the L-bracket to the receiving plate after the clamping distance is adjusted to the width of the side rail;

wherein the at least one guide rail includes a threaded rail bore, the clamp further including at least one tightening screw, the tightening screw having:

a threaded bolt with first and second ends, the threaded bolt being screwably disposed through the threaded rail bore;

a pusher plate coupled to the first end of the threaded bolt a wingnut screwably engaged with the threaded bolt adjacent to the second end of the threaded bolt a locking nut screwably engaged with the threaded bolt adjacent to the wingnut, the locking nut and the wingnut being arranged in a double-nut configuration; and a hexagonal nut screwably engaged with the threaded bolt adjacent to the locking nut;

wherein rotation of the threaded bolt along a tightening direction is configured to cause the pusher plate to advance toward and frictionally engage an inside surface of the side rail of the step ladder to sandwich the side rail between the receiving plate and the pusher plate, wherein rotation of the hexagonal nut along a tightening direction causes the hexagonal nut to advance toward the guide rail, wherein the handle portion of the elongate member is configured to be positioned above the uppermost platform of a step ladder when the shaft of the elongate member is extended into the selected longitudinal position with respect to the clamp.

2. The safety accessory of claim 1, wherein the clamp includes at least one placement protrusion structured to rest on one of the plurality of steps of the step ladder to assist with positioning of the clamp when the clamp is removeably attached to the selected location on the side rail of the ladder.

3. The safety accessory of claim 1, wherein the shaft of the elongate member includes a plurality of length adjustment holes, the receptacle of the clamp includes at least one locking hole, and the positioning structure of the clamp includes a locking pin having a transverse bore, the locking pin structured to be removeably inserted through the locking hole and a selected set of the length adjustment holes to position the shaft into the selected longitudinal position with respect to the clamp;

a cotter pin structured to be inserted into the transverse bore of the locking pin for preventing removal of the locking pin from the locking hole and the selected set of length adjustment holes; and a chain having first and second ends, the first end of the chain being coupled to the locking pin, the second end of the chain being coupled to the receptacle, the chain structured to maintain the locking pin with the receptacle when the locking pin is not inserted through the locking hole and the selected set of length adjustment holes.

4. The safety accessory of claim 3, wherein the positioning structure of the clamp further includes a tightening ring configured to be tightened around the shaft of the elongate member for rigidly maintaining the shaft of the elongate member within the receptacle of the clamp.

5. The safety accessory of claim 1, wherein an inside surface of the receptacle includes a guide protrusion and an outside surface of the shaft of the elongate member includes a travel groove extending longitudinally along the shaft and a plurality of circumferentially disposed placement grooves corresponding to the plurality of length adjustment holes, wherein engagement of the guide protrusion with a selected one of the placement grooves prevents longitudinal displacement of the shaft with respect to the receptacle, and engagement of the guide protrusion with the travel groove permits longitudinal displacement of the shaft with respect to the receptacle.

6. The safety accessory of claim 1, wherein the harness includes a strap having a first end, a second end and a length;

a first strap clip coupled to the first end of the strap;

a second strap clip coupled to the second end of the strap, the first and second strap clips being configured to be removeably coupled to the strap ring of the handle portion; and a length adjustment buckle structured to permit adjustment of the length of the strap.

7. A safety accessory for stabilizing a user on a step ladder having an uppermost platform, a plurality of steps, and at least one side rail, the safety accessory comprising:

an elongate member having a shaft and at least one handle portion extending perpendicularly to the shaft and structured to be gripped by the user, the handle portion having a strap ring;

a strap extender including an extender body, an extender strap extending from the extender body, a first coupling clip attached to the extender strap, a second coupling clip attached to the extender body, the second coupling clip being configured to removeably attach to the strap ring of the handle portion, the strap extender being configured to permit adjustment of a length of the extender strap;

a harness configured to removeably couple to the first coupling clip of the strap extender; and a clamp configured to removeably attach to a selected location on a side rail of a step ladder, the clamp having:

a receptacle structured to slideably receive the shaft of the elongate member and a positioning structure configured to maintain the shaft of the elongate member into a selected one of a plurality of longitudinal positions with respect to the clamp a receiving plate having a plate flange and at least one guide notch, an L-bracket having a bracket flange and at least one guide rail, the guide notch of the receiving plate being configured to slideably receive the guide rail of the L-bracket for adjusting a clamping distance between the plate flange and the bracket flange, the clamping distance being adjustable to a width of the side rail for gripping the side rail between the plate flange and the bracket flange; and at least one positioning screw configured to lock the L-bracket to the receiving plate after the clamping distance is adjusted to the width of the side rail;

wherein the at least one guide rail includes a threaded rail bore, the clamp further including at least one tightening screw, the tightening screw having:

a threaded bolt with first and second ends, the threaded bolt being screwably disposed through the threaded rail bore;

a pusher plate coupled to the first end of the threaded bolt;

a wingnut screwably engaged with the threaded bolt adjacent to the second end of the threaded bolt;

a locking nut screwably engaged with the threaded bolt adjacent to the wingnut, the locking nut and the wingnut being arranged in a double-nut configuration; and a hexagonal nut screwably engaged with the threaded bolt adjacent to the locking nut;

wherein rotation of the threaded bolt along a tightening direction is configured to cause the pusher plate to advance toward and frictionally engage an inside surface of the side rail of the step ladder to sandwich the side rail between the receiving plate and the pusher plate, wherein rotation of the hexagonal nut along a tightening direction causes the hexagonal nut to advance toward the guide rail;

wherein the handle portion of the elongate member is configured to be positioned above the uppermost platform of a step ladder when the shaft of the elongate member is extended into the selected longitudinal position with respect to the clamp.

8. The safety accessory of claim 7, wherein the clamp includes at least one placement protrusion structured to rest on one of the plurality of steps of the step ladder to assist with positioning of the clamp when the clamp is removeably attached to the selected location on the side rail of the ladder.

9. The safety accessory of claim 7, wherein the shaft of the elongate member includes a plurality of length adjustment holes, the receptacle of the clamp includes at least one locking hole, and the positioning structure of the clamp includes a locking pin having a transverse bore, the locking pin structured to be removeably inserted through the locking hole and a selected set of the length adjustment holes to position the shaft into the selected longitudinal position with respect to the clamp;

a cotter pin structured to be inserted into the transverse bore of the locking pin for preventing removal of the locking pin from the locking hole and the selected set of length adjustment holes; and a chain having first and second ends, the first end of the chain being coupled to the locking pin, the second end of the chain being coupled to the receptacle, the chain structured to maintain the locking pin with the receptacle when the locking pin is not inserted through the locking hole and the selected set of length adjustment holes.

10. The safety accessory of claim 9, wherein the positioning structure of the clamp further includes a tightening ring configured to be tightened around the shaft of the elongate member for rigidly maintaining the shaft of the elongate member within the receptacle of the clamp.

11. The safety accessory of claim 7, wherein an inside surface of the receptacle includes a guide protrusion and an outside surface of the shaft of the elongate member includes a travel groove extending longitudinally along the shaft and a plurality of circumferentially disposed placement grooves corresponding to the plurality of length adjustment holes, wherein engagement of the guide protrusion with a selected one of the placement grooves prevents longitudinal displacement of the shaft with respect to the receptacle, and engagement of the guide protrusion with the travel groove permits longitudinal displacement of the shaft with respect to the receptacle.

12. The safety accessory of claim 7, wherein the harness includes a strap having a first end, a second end and a length;

a first strap clip coupled to the first end of the strap;

a second strap clip coupled to the second end of the strap, the first and second strap clips being configured to be removeably coupled to first coupling clip of the strap extender; and a length adjustment buckle structured to permit adjustment of the length of the strap.

* * * * *